US010725405B2

(12) United States Patent
Akizuki et al.

(10) Patent No.: US 10,725,405 B2
(45) Date of Patent: Jul. 28, 2020

(54) FIXING DEVICE

(71) Applicant: CANON KABUSHIKI KAISHA, Tokyo (JP)

(72) Inventors: Tomoo Akizuki, Kawasaki (JP); Masahiko Suzumi, Yokohama (JP); Tatsuya Kinukawa, Kawasaki (JP); Takeharu Nakada, Saitama (JP); Ryo Morihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/156,942

(22) Filed: Oct. 10, 2018

(65) Prior Publication Data

US 2019/0113868 A1 Apr. 18, 2019

(30) Foreign Application Priority Data

Oct. 13, 2017 (JP) ..... 2017-199625

(51) Int. Cl.
*G03G 15/20* (2006.01)

(52) U.S. Cl.
CPC ..... *G03G 15/2053* (2013.01); *G03G 15/2028* (2013.01); *G03G 15/2064* (2013.01); *G03G 2215/20* (2013.01)

(58) Field of Classification Search
CPC ..... G03G 15/2053; G03G 15/2042; G03G 15/2017; G03G 2215/2035; G03G 15/2064
See application file for complete search history.

(56) References Cited

U.S. PATENT DOCUMENTS

2011/0026990 A1* 2/2011 Arimoto ..... G03G 15/2053 399/333
2014/0161499 A1* 6/2014 Ueda ..... G03G 15/2053 399/329
2015/0261145 A1* 9/2015 Taguchi ..... G03G 15/206 399/329
2015/0338795 A1* 11/2015 Yamaguchi ..... H05B 6/107 219/216
2015/0338804 A1* 11/2015 Nakashima ..... G03G 15/2053 219/216
2016/0216659 A1* 7/2016 Ikegami ..... G03G 15/2053

FOREIGN PATENT DOCUMENTS

JP 2003257592 A 9/2003
JP 2014052662 A 3/2014

* cited by examiner

*Primary Examiner* — Walter L Lindsay, Jr.
*Assistant Examiner* — Jessica L Eley
(74) *Attorney, Agent, or Firm* — Canon U.S.A., Inc. I.P. Division

(57) ABSTRACT

A fixing device including a rotatable tubular film, a heater including a substrate and a heat generating resistor, the heater including a first surface in contact with an inner surface of the film and a second surface opposite to the first surface, the heater extending in a longitudinal direction of the substrate, and a heat conducting member extending in the longitudinal direction and including a heater contact portion in contact with the second surface. The heat conducting member includes a film contact portion at a position adjacent to the first surface, the film contact portion being in contact with the inner circumferential surface, and on one side in the longitudinal direction, the heat generating resistor extends outside of a longitudinal end portion of the film contact portion, and the heater contact portion extends outside of the film contact portion.

11 Claims, 18 Drawing Sheets

FIXING DEVICE

BACKGROUND OF THE INVENTION

Field of the Invention

The present disclosure relates to a fixing device used in an image forming apparatus, such as a copier, a printer, or a facsimile, that is equipped with a function of forming an image on a recording material.

Description of the Related Art

In fixing devices used in electrophotographic system image forming apparatuses, a fixing device that adopts a film heating method is known. The fixing device includes a tubular fixing film, a plate-shape heater that comes in contact with an inner surface of the fixing film, and a pressure roller that forms a nip portion by contacting an outer surface of the fixing film. A recording material that carries a toner image is conveyed and heated by the nip portion so that the toner image is fixed to the recording material. Since the heat capacity of the fixing film is small in the fixing device adopting the film heating method, the fixing device has advantages such as the warming up time being short and power consumption capable of being suppressed to the lowest degree possible.

Incidentally, a configuration has been disclosed in which a heat conducting member having a thermal conductivity that is higher than that of a substrate of the heater is provided so as to be in contact with a surface on the other side of a surface that is in contact with the fixing film of the heater. The heat conducing member extends so as to come in contact with the fixing film (Japanese Patent Laid-Open No. 2003-257592). Since, in addition to a heat conducting path from the heater to the fixing film, a heat conducting path from the heater to the fixing film through heat conducting member is formed, the fixing film can be efficiently heated. Furthermore, by having the heat conducting member contact the heater and the fixing film across the longitudinal direction of the heater and the fixing film, a sheet non-passing portion temperature increase can be suppressed from occurring when small-sized recording materials are continuously fixed.

However, when the heat conducting member is contacted to the heater and the fixing film across the longitudinal direction of the heater and the fixing film, there are cases in which the fixability of end portions of the above becomes degraded due to a decrease in temperature caused by heat radiation from the end portions. In particular, when a wide recording material is fixed, there are cases in which an offset occurs in the image end portions (hereinafter, described as "offsets in the end portions") due to insufficient melting of the toner at the image end portion.

SUMMARY OF THE INVENTION

The present disclosure provides a fixing device that is capable of achieving both a suppression in the sheet non-passing portion temperature increase and an improvement in the end portion fixability.

In the configuration according to the present disclosure, a fixing device includes a plate-shaped heater having a rotatable tubular film, a first surface, and a second surface on the opposite side of the first surface; a heat conducting member including a heater contact portion that is in contact with the second surface of the heater, the heater contact portion being long in the longitudinal direction of the heater and is in contact with the elongated plate-shaped heater that is in contact with an inner surface of the film with the first surface. The fixing device heats the toner image with heat of the heater through the film and fixes the toner image to the recording material. The heat conducting member includes a film contact portion that extends in the direction approaching the film and that contacts the inner surface of the film at, in the rotation direction of the film, at least either an area on an upstream side of an upstream end of the heater and an area on a downstream side of a downstream end of the heater. In the longitudinal direction of the heat conducting member, a longitudinal end portion of the heater contact portion extends outside of a longitudinal end portion of the film contact portion on the same side.

Further features of the present invention will become apparent from the following description of exemplary embodiments with reference to the attached drawings.

DESCRIPTION OF THE EMBODIMENTS

First Exemplary Embodiment

A configuration of a main body of an image forming apparatus according to the present exemplary embodiment will be described first and, then, a fixing device according to the present exemplary embodiment will be described in detail.

(1) Image Forming Apparatus

Figure 1:
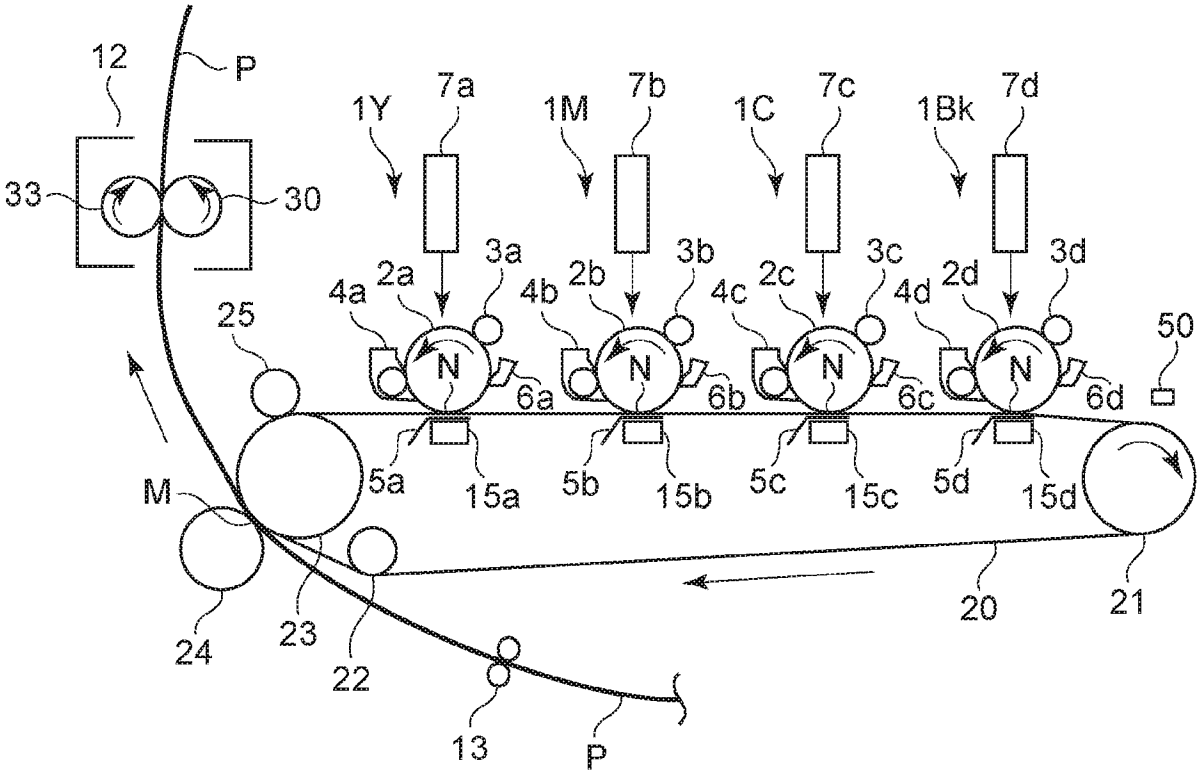
FIG. 1 is a schematic block diagram of an image forming apparatus according to a first exemplary embodiment.

Referring to FIG. 1, a configuration of an image forming apparatus according to a first exemplary embodiment will be described. FIG. 1 is a schematic block diagram of a typical color image forming apparatus (an intermediate transfer full color printer adopting an electrophotographic printing method in the present exemplary embodiment) according to the first exemplary embodiment of the present disclosure.

The above color image forming apparatus includes four image forming units 1Y, 1M, 1C, and 1Bk that forms images of yellow, magenta, cyan, and black, respectively. The four image forming units are disposed in a line at uniform intervals.

Photosensitive drums 2*a*, 2*b*, 2*c*, and 2*d* serving as image carrying members are installed in the image forming units 1Y, 1M, 1C, and 1Bk, respectively. Charge rollers 3*a*, 3*b*, 3*c*, and 3*d*, developing devices 4*a*, 4*b*, 4*c*, and 4*d*, transfer sheets 5*a*, 5*b*, 5*c*, and 5*d*, and drum cleaning devices 6*a*, 6*b*, 6*c*, and 6*d* are installed around the photosensitive drums 2*a*, 2*b*, 2*c*, and 2*d*, respectively. Furthermore, exposure devices 7*a*, 7*b*, 7*c*, and 7*d* are installed around the photosensitive drums 2*a*, 2*b*, 2*c*, and 2*d*, respectively, and above the charge rollers 3*a*, 3*b*, 3*c*, and 3*d* and the developing devices 4*a*, 4*b*, 4*c*, and 4*d*, respectively. The developing devices 4*a*, 4*b*, 4*c*, and 4*d* contain yellow toner, magenta toner, cyan toner, and black toner, respectively, that have negative charging characteristics.

The photosensitive drums 2*a*, 2*b*, 2*c*, and 2*d* in the present exemplary embodiment are negatively charged organic photoreceptors and each include a photosensitive layer on an aluminum drum base. The photosensitive drums 2*a*, 2*b*, 2*c*, and 2*d* are rotationally driven in an arrow direction (counterclockwise direction) at a predetermined processing speed with a driving device (not shown).

The charge rollers 3*a*, 3*b*, 3*c*, and 3*d* are in contact with the photosensitive drums 2*a*, 2*b*, 2*c*, and 2*d* at a predetermined pressure and charging biases are applied thereto with a charging bias power source (not shown). Furthermore, surfaces of the photosensitive drums 2*a*, 2*b*, 2*c*, and 2*d* are each uniformly charged to a predetermined potential. Note that in the present exemplary embodiment, the photosensitive drums 2*a*, 2*b*, 2*c*, and 2*d* are charged to a negative polarity with the charge rollers 3*a*, 3*b*, 3*c*, and 3*d*, respectively.

The exposure devices (laser scanner device) 7*a*, 7*b*, 7*c*, and 7*d* output laser beams, which have been modulated so as to correspond to sequential, electric, and digital pixel signals of image information input from a host computer (not shown), from laser output portions (not shown). The laser beams expose images on the surfaces of the photosensitive drums 2*a*, 2*b*, 2*c*, and 2*d* through reflection mirrors (not shown). As a result, electrostatic latent images corresponding to the image information are formed on the surfaces of the photosensitive drums 2*a*, 2*b*, 2*c*, and 2*d* charged by the charge rollers 3*a*, 3*b*, 3*c*, and 3*d*.

The developing devices 4*a*, 4*b*, 4*c*, and 4*d* adopt a contact developing method as the developing method, and include development rollers serving as developer carrying members. The thin layered toner carried on the development rollers are conveyed to opposed portions (developing portions) opposing the photosensitive drums 2*a*, 2*b*, 2*c*, and 2*d* with the development rollers rotated by development drive members (not shown). Subsequently, the electrostatic latent images formed on the photosensitive drums are developed (reversal developed) as toner images with the developing biases applied on the development rollers with development voltage applying members (not shown).

The development rollers and the photosensitive drums in the developing devices 4*a*, 4*b*, 4*c*, and 4*d* abut against each other during a full color image forming mode, and during a monochrome image forming mode described later, the development rollers and the photosensitive drums other than those of the developing portion that forms the image are separated from each other. The above is to prevent degradation and exhaustion of the development rollers and the toner.

The transfer sheets 5*a*, 5*b*, 5*c*, and 5*d* serving as sheet-shaped transferring members are each formed of a sheet formed of resin having electroconductivity. Furthermore, transfer pads 15*a*, 15*b*, 15*c*, and 15*d* serving as transfer sheet pressuring members are each formed of an elastic body formed of rubber and the like.

An endless-belt-shaped semiconductive intermediate transfer belt 20 is formed of resin. The intermediate transfer belt 20 is stretched by a drive roller 21, a tension roller 22, and a secondary transfer opposed roller 23. Tension is applied to the intermediate transfer belt 20 by applying pressure to the tension roller 22 with a pressure member (not shown). The intermediate transfer belt 20 is rotationally driven with the drive roller 21.

The intermediate transfer belt 20, which is an endless-belt-shaped intermediate transfer member, abuts against the photosensitive drum 2*a*. The transfer sheet 5*a* abuts against the intermediate transfer belt 20, Furthermore, the transfer sheet 5*a* abuts against the transfer pad 15*a* and is pressed by the transfer pad 15*a*. As a result, the transfer pad 15*a* presses the photosensitive drum 2*a* with the transfer sheet 5*a* and the intermediate transfer belt 20 interposed therebetween. A power supply (not shown) for primary transfer serving as a primary transfer power supply is connected to the transfer sheet 5*a*. A toner image developed on the photosensitive drum 2*a* is primarily transferred onto the rotating intermediate transfer belt 20 with the transfer sheet 5*a* to which a primary transfer voltage has been applied.

The above described configuration is a transfer portion configuration of the image forming unit 1Y. The other image forming units 1M, 1C, and 1Bk have similar configurations. The yellow and black toner images formed on the photosensitive drums 2*c* and 2*d* of the image forming units 1C and 1Bk are, at the primary transfer portions, sequentially overlapped onto the yellow and magenta toner images that have been superimposed and transferred onto the intermediate transfer belt 20 in the same manner as that of the image forming unit 1Y. As a result, a full-colored toner image is formed on the intermediate transfer belt 20.

A secondary transfer roller 24 presses the secondary transfer opposed roller 23 from the outside of the intermediate transfer belt 20. The secondary transfer roller 24 can be abutted against and separated from the intermediate transfer belt 20. A recording material P is conveyed to an abutting portion between the secondary transfer roller 24 and the intermediate transfer belt 20. A power supply (not shown) for secondary transfer serving as a secondary transfer power supply is connected to the secondary transfer roller 24. The toner images that have been primarily transferred onto the intermediate transfer belt 20 are secondarily transferred onto the conveyed recording material P with the secondary transfer roller to which a secondary transfer voltage has been applied.

A charge roller 25 for cleaning serving as a belt cleaning device for removing and collecting residual toner remaining on the surface of the intermediate transfer belt 20 is in contact with the intermediate transfer belt 20 at a portion downstream of the abutting portion between the intermediate transfer belt 20 and the secondary transfer roller 24. A power supply (not shown) for cleaning is connected to the charge roller 25 for cleaning. The residual toner is removed by the charge roller 25 for cleaning to which a cleaning voltage has been applied.

Furthermore, in order to obtain a stable color registration and image density regardless of various conditions, such as the change in the used environment, the number of sheets subjected to image formation, and the like, a sensor unit 50 for color registration correction and density correction is provided near the drive roller 21. The sensor unit 50 for color registration correction and density correction includes a light emitting element such as an LED, and a light receiving element such as a photodiode or a CdS.

A fixing device 12 including a fixing film 30, and a pressure roller 33 is installed downstream of the secondary transfer roller 24 in a conveyance direction of the recording material P. By conveying the recording material P between the fixing film 30 and the pressure roller 33, a toner image t is heated and compressed at the same time. The toner image t is fixed on a surface of the recording material P as a permanently fixed image.

Furthermore, when performing a color registration correction and a density correction, the toner image is formed on the intermediate transfer belt 20, and light is projected onto the toner image and the portions where there is no toner image on the rotating and moving intermediate transfer belt 20 from a light emitting element. Subsequently, the position where toner image patches have been formed and the densities of the toner image patches are measured by receiving the reflected light with a light receiving element. When a color registration correction is performed, the interval between where there is a toner image and where there is no toner image is measured. Furthermore, when a density correction is performed, the density of the toner image is measured.

The color image forming apparatus of the present exemplary embodiment adapts to a plurality of sheet sizes, and can print sheets of various sizes including a Letter-sized sheet (about 216 mm by 279 mm), a A4-sized sheet (210 mm by 297 mm), and a A5-sized sheet (148 mm by 210 mm). The color image forming apparatus is a printer that basically performs short edge feeding of the sheet (conveying the sheet so that the long sides are parallel to the conveyance direction), and the largest size (the largest width) among the adapted regular sizes of the recording material (the adapted sheet sizes on the catalogue) is that of the Letter-sized sheet, which is about 216 mm in width. In the present proposal, the sheets (the A4-sized sheet and the A5-sized sheet) that have sheet widths that are smaller than the maximum size to which the image forming apparatus can adapt is defined as a small-sized sheet.

(2) Fixing Device

A description of the fixing device 12 will be given. The fixing device 12 is a device adopting a film heating method. The fixing device 12 adopting the film heating method is a device that uses an endless-belt-shaped member as a heat resistant film in which the film is rotationally driven by rotational driving force of a pressure member.

Figure 2:
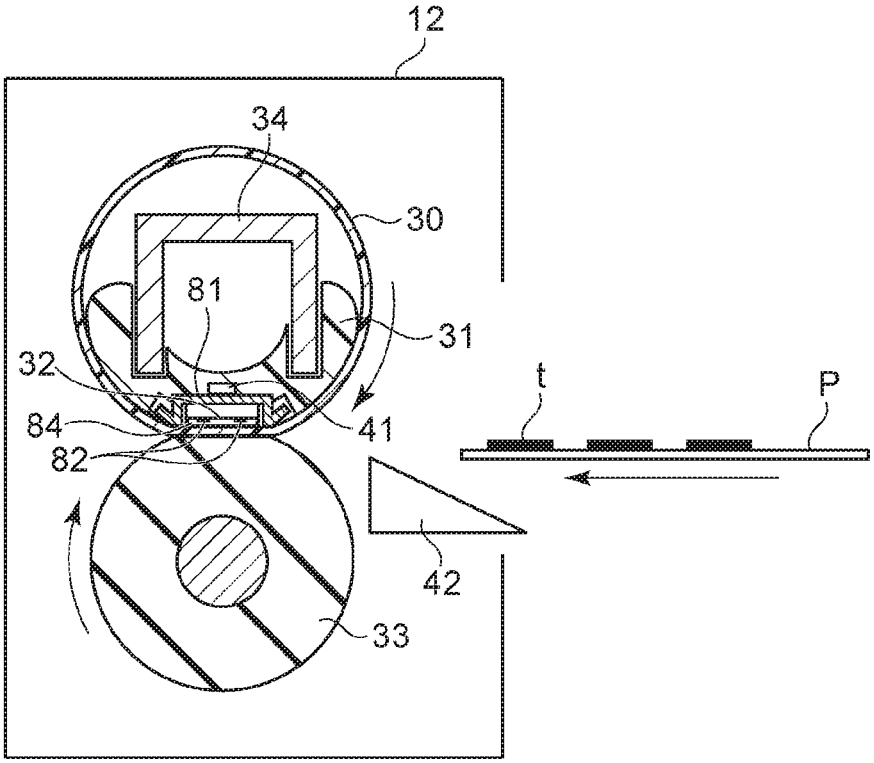
FIG. 2 is a schematic cross-sectional view of a fixing device of a first exemplary embodiment.
Figure 3:
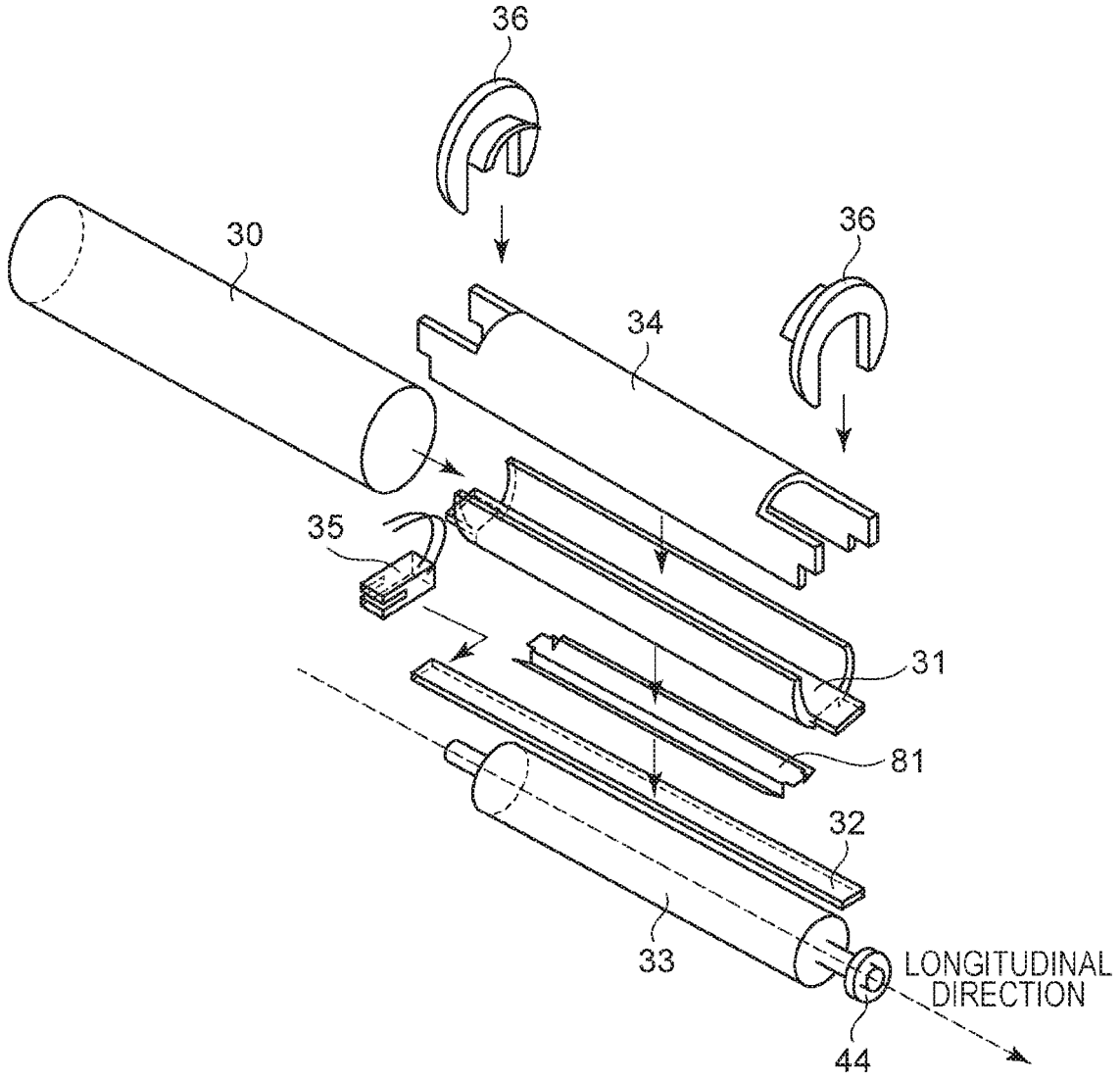
FIG. 3 is a decomposed perspective view of a film unit according to the first exemplary embodiment.
Figure 4:
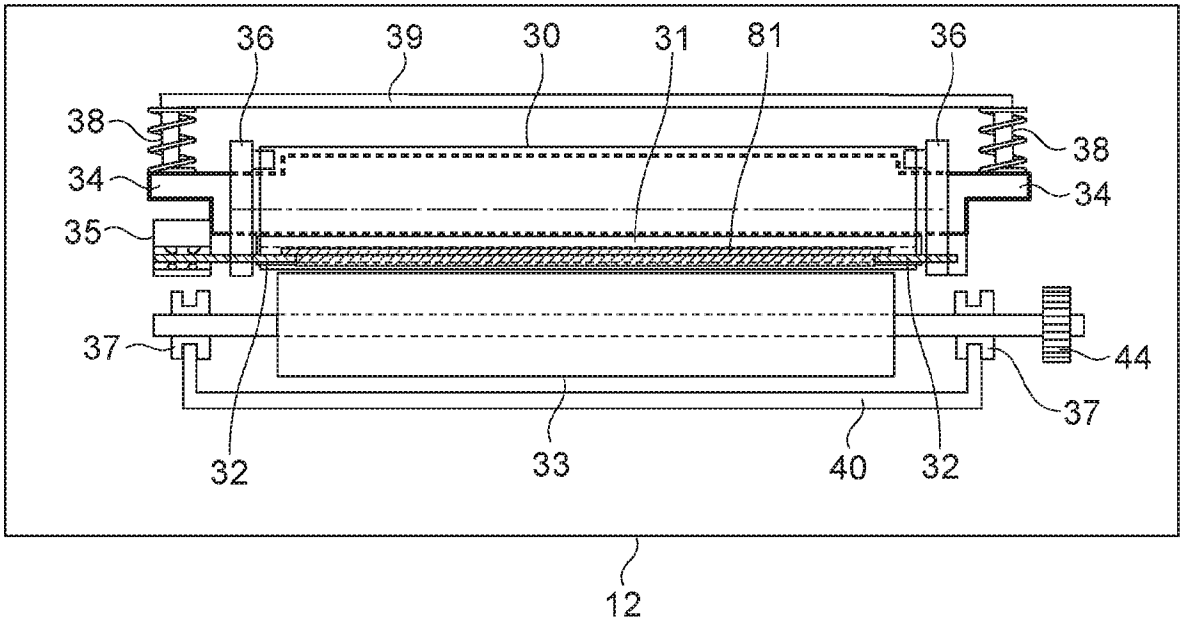
FIG. 4 is a partially cutaway front view of the fixing device according to the first exemplary embodiment.

Hereinafter, details of the fixing device adopting the film heating method will be described. FIG. 2 is a cross-sectional view illustrating the fixing device of the color image forming apparatus according to the first exemplary embodiment. Furthermore, FIG. 3 is a perspective view of a film unit used in the fixing device in a decomposed state, and FIG. 4 is a partially cutaway front view of the fixing device.

A heater holder 31 functions as a support member that supports a heater 32 as well as a member that guides the cylindrical fixing film 30 so that the cylindrical fixing film 30 rotates. The heater holder 31 can suitably use a highly heat resistant resin, such as polyimide, polyamide-imide, PEEK, PPS, liquid crystal polymer, or may suitably use a composite material, such as a composite of the above resin and ceramics, metal, or glass. Among the above, liquid crystal polymer, which has a high withstanding temperature limit, which can be molded and formed, and which is excellent in dimensional stability can be suitably used in particular. Liquid crystal polymer has the following advantages. First, since the withstanding temperature limit is high, the degree of freedom in the temperature setting of the heater is high. Furthermore, since molding and forming can be performed, productivity is good and mass production can be performed. Moreover, since liquid crystal polymer has excellent dimensional stability, advantages such as the pressing force against the pressure member being uniform and the sheet conveying performance becoming stable can be obtained.

The heater 32 has an elongated plate shape. The heater 32 includes a highly heat resistant ceramic substrate (alumina having a thermal conductivity of 30 W/(m·K) is used in the present exemplary embodiment) and a heating resistor 82 and electrodes using Ag/Pd(silver-palladium) are printed thereon. Furthermore, a glass coating 84 is provided to protect the heating resistor 82. The heating resistor 82 includes two heat generating elements, and two electrodes are disposed on one side thereof. A glass coating 84 layer is disposed on a side that is in contact with the fixing film 30.

The fixing film 30 is a rotatable member in which an elastic layer is provided on the outside of an endless-belt-shaped (cylindrical) base layer and in which a releasing layer is further provided outside the elastic layer.

The releasing layer is a layer that prevents toner offset that occurs when the toner that has temporarily adhered to the surface of the fixing film 30 moves to the recording material P once again. A fluorocarbon resin, such as PFA, PTFE, or FEP, that has a thickness of 5 to 70 μm and that has satisfactory releasing properties can be suitably used for the releasing layer. In the present exemplary embodiment, by using a PFA tube having a thickness of 15 μm, a uniform fluororesin layer can be formed easily.

The elastic layer is, in many cases, used particularly in fixing devices of color image forming apparatuses. Owing to the elastic layer, regardless of the unevenness of the surface of the recording material P, the toner image t can be heated while enclosing the toner image t and, as a result, a uniform color gloss image can be obtained. In the present exemplary embodiment, a silicone rubber layer having a relatively high thermal conductivity is used as the elastic layer. With the above, a higher on-demand property and a more satisfactory fixing property can be obtained.

The base layer is a layer on the innermost surface side of the fixing film 30 and is in contact with the heater. The base layer has an excellent heat resistant property, and polyimide, polyamide-imide, PEEK, or the like that has flexibility is used. The base layer itself is formed to have a thickness of about 10 to 100 μm. In order to conduct the heat of the heater to the toner image t on the recording material P in a more efficient manner in a nip portion N where the heater 32 and the pressure roller oppose each other, it is important that the fixing film 30 has flexibility that allows the fixing film 30 to sufficiently follow the shape of the heater and adhere thereto.

In order to further improve the flexibility, it is effective to reduce the thickness of the layer. Meanwhile, since the fixing film 30 maintains the mechanical strength with the base layer, when the thickness of the base layer is excessively small, the strength decreases and the film becomes deformed and wrinkles are easily formed, or the edge portion becomes easily buckled; accordingly, the required strength cannot be obtained. In order to prevent the above from happening, the thickness needs to be at least 10 μm when the base layer is formed of polyimide. In the present exemplary embodiment, a cylindrical polyimide resin that has a thickness of 50 μm when measured with a micrometer, and that has an inside diameter of 18 mm is used.

Referring to the cross-sectional view in FIG. 2, a configuration of the fixing device will be described. A reinforcing member 34 is formed of metal such as iron, and is a member that has a strength that does not allow the heater holder 31 to become greatly deformed even when the heater holder 31 receives a pressure that presses the heater holder 31 towards the pressure roller side. The heater 32 is pressed towards the pressure roller 33 side with a pressing member described later through the heater holder 31 and the reinforcing member 34. The area in which the pressed pressure roller 33 and the fixing film 30 adhere to each other is the fixing nip portion N (serving as a pressure contact area). Furthermore, the position where the pressure roller 33 applies pressure and the middle position of the heater 32 in the recording material conveyance direction are substantially the same.

Referring next to the perspective view in FIG. 3, a configuration of the film unit will be described. A cross section of the heater holder 31 has a substantially tub shape, and the reinforcing member 34 is fitted inside the tub shape. A heater receiving groove is provided on the side of the heater holder 31 opposing the pressure roller 33, and the heater 32 is fitted in the heater receiving groove so as to be fitted in the desired position. In so doing, an aluminum plate 81 is disposed between the heater 32 and the heater receiving groove. Details of the aluminum plate 81 will be described later. Furthermore, a thermistor (not shown) is attached to the heater holder 31. The thermistor is disposed at a position abutting against the aluminum plate 81 when the heater 32 and the aluminum plate 81 are fitted in the heater receiving groove. The fixing film 30 is fitted outside of the heater holder 31, to which the components described above has been installed, with an allowance in the circumferential length. Hereinafter, the axial direction of the cylindrical shape of the fixing film 30 (an arrow direction in the drawing in which the fixing film is inserted) is referred to as a longitudinal direction. Projecting portions of the reinforcing member 34 protrude from both ends of the fixing film 30. Flange members 36 are fitted to the projecting portions. The members described above are assembled, overall, as the film unit. A power supplying terminal of the heater 32 also protrudes from an end of the fixing film 30 on one side, and a power supplying connector 35 is fitted thereto. The power supplying connector 35 in contact with the electrode portion of the heater 32 at a contact pressure forms a power supply path.

The pressure roller 33 serving as a pressing rotation member includes a metal core formed of metal, a silicone rubber having an elastic property, and a releasing layer having releasability. A drive gear 44 is attached to an end portion of the metal core of the pressure roller 33 on one side. The drive gear 44 receiving rotational driving force from a drive member (not shown) rotates the pressure roller 33.

Referring next to the front view in FIG. 4, a configuration of the fixing device will be described. The flange members 36 restrict the longitudinal movement of the rotating and running fixing film 30, and restrict the position of the fixing film in the fixing device in operation. A left side and a right side of flanges (the portions that restrict the fixing film end portions) of the flange members 36 are installed so that a distance therebetween is larger than the length of the fixing film 30 in the longitudinal direction.

The above is to avoid damaging the film end portion during ordinary use. Furthermore, a length of the pressure roller 33 in the longitudinal direction is about 10 mm shorter than that of the fixing film 30. The above is to prevent grease pushed out from the end portions of the fixing film 30 from coming in contact with the pressure roller and making the pressure roller loose grip force and slip.

The film unit is provided so as to oppose the pressure roller 33, and is supported by a top plate-side housing 39 of the fixing device so that the movement in the left-right direction in the drawing is restricted and the movement in the up-down direction is allowed. Pressure applying springs 38 are attached to a top plate-side housing 39 of the fixing device in a compressed state. Pressing force of the pressure applying springs is received by the projecting portions of the reinforcing member 34. The reinforcing member 34 is pressed towards the pressure roller 33 side, and the overall film unit is pressed towards the pressure roller side. Bearings 37 are provided so that the metal core of the pressure roller 33 is rotatably supported. Pressure force from the film unit is received by the bearings 37 with the pressure roller in between. In order to rotatably support the metal core of the pressure roller that becomes relatively high in temperature, a material use for the bearings is a material that is heat resistant and that has excellent slidability. The bearings 37 are attached to a bottom-side housing 40 of the fixing device.

Referring next to the cross-sectional view in FIG. 2, a movement of the fixing device will be described. The aluminum plate 81 is disposed so as to come in contact with the surface of the heater 32 on the side opposite to the side in contact with the fixing film 30. Furthermore, a thermistor 41 that is a temperature detection element is provided so as to be in contact with the aluminum plate 81. The electric power supplied to the heater 32 is controlled with a control member (not shown) on the basis of a detection temperature of the thermistor 41 so that the heater 32 is at a desired temperature (a target temperature).

The pressure roller receives rotational drive from a drive member (not shown), and the fixing film 30 is driven and rotated by frictional force between the pressure roller 33 and an outer surface of the fixing film 30 at the fixing nip portion N. The fixing film 30 and the heater 32, and the fixing film 30 and the heater holder 31 slide against each other while being pressed; accordingly, grease (lubricant) is applied to the surface of the heater to relieve the frictional resistance of the above. The grease is a heat stable grease in which a fluorocarbon resin that is a solid lubricant is mixed and dispersed in fluorine oil serving as a base in which the fluorine oil is a liquid lubricant. The grease is interposed between the film and the heater so that even when used for a long period, a satisfactory sliding property is maintained.

As described above, the recording material P on which an image is formed by transferring the toner image t thereon is conveyed between the fixing film 30 and the pressure roller 33. A guiding member 42 is provided so that a front end of the recording material P is reliably introduced into the fixing nip portion N. The toner image t on the recording material P is melted by receiving sufficient pressure and heat at the fixing nip portion N so the toner image t is fixed on the recording material P as a permanently fixed image.

(3) Aluminum Plate

A description of the aluminum plate 81 that is a feature of the present exemplary embodiment will be given in detail next. As illustrated in the cross-sectional view in FIG. 2, the aluminum plate 81 serving as a high heat conducting member is in contact with the surface (a second surface) of the heater 32 that is a surface opposite to the surface (a first surface) in contact with the fixing film 30. The groove is provided on the side of the heater holder 31 opposing the pressure roller 33, and the aluminum plate 81 and the heater 32 fitted in the heater receiving groove are supported at the desired positions.

In a cross section of the aluminum plate 81 that is perpendicular to the longitudinal direction thereof, the end portions of the aluminum plate 81 in a transverse direction (a recording material conveyance direction) are each bent in a Z-shape. The Z-shapes are provided so as to be in contact with both the heater 32 and the fixing film 30. More specifically, the aluminum plate 81 is formed so that the end portions in contact with the heater 32 and the end portions in contact with the fixing film 30 are connected to each other with portions extending from the second surface towards the first surface in between. With such a configuration, other than heat conducting path from the first surface of the heater 32 to the fixing film 30, heat conducting paths from the heater 32 to the fixing film 30 though the aluminum plate 81 are formed. As a result, an advantage is obtained in dealing with the increase in speed that needs to achieve high heat conducting efficiency from the heater to the film.

The material of the aluminum plate 81 is, other than aluminum, desirably metal that has high thermal conductivity such as gold, silver, or copper. As the aluminum plate 81, magnesium or nickel that has good thermal conductivity, furthermore, an aluminum alloy in JIS series 3000, JIS series 5000, or JIS series 6000 in which the above metal is the main material, or a copper alloy can be used. The heat conducting member desirably has a thermal conductivity that is higher than the thermal conductivity (30 W/(m·K) that is the thermal conductivity of alumina that is the base material of the heater 32) of the substrate of the heater.

In the present exemplary embodiment, pure aluminum (A1050) is used in the aluminum plate 81, and the thermal conductivity thereof is 230 W/(m·K). Since compared with the thermal conductivity of the heater 32, the above thermal conductivity is extremely high; accordingly, the effect of suppressing a sheet non-passing portion temperature increase is large.

Figure 5A:
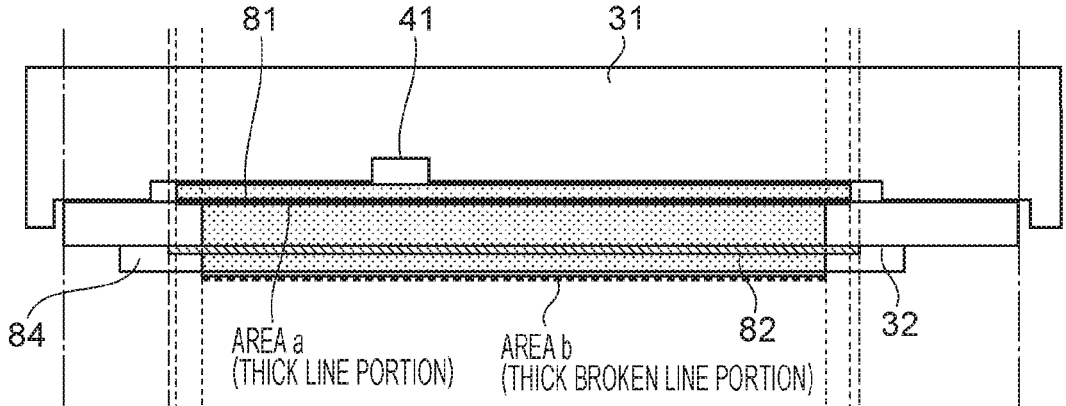
FIG. 5A is a schematic view of a heater, an aluminum plate, a heater holder, and the like according to the first exemplary embodiment viewed in a recording material conveyance direction.
Figure 5B:
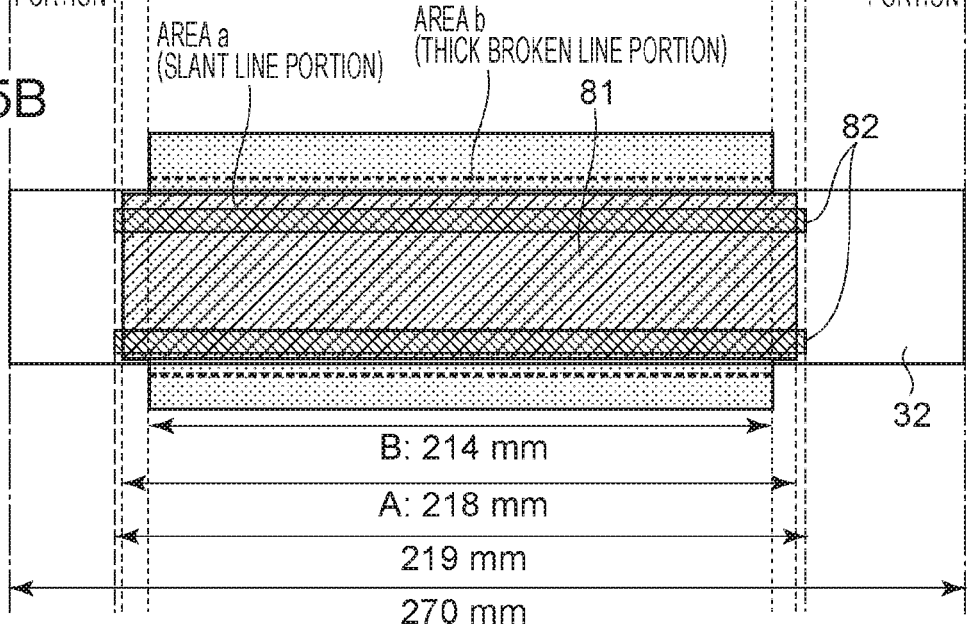
FIG. 5B is schematic view of the heater and the aluminum plate viewed from the heater holder side according to the first exemplary embodiment.
Figure 5C:
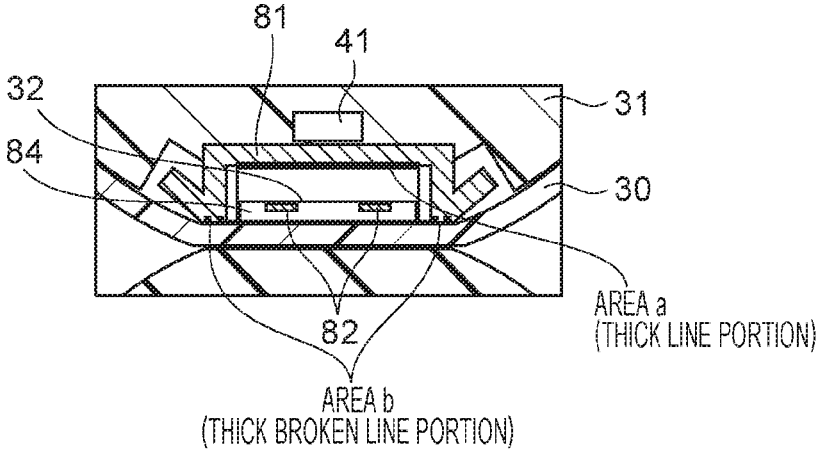
FIG. 5C is a schematic cross-sectional view of a vicinity of a nip portion of the fixing device according to the first exemplary embodiment.

Referring next to FIGS. 5A to 5C, a longitudinal positional relationship of the aluminum plate 81 of the present exemplary embodiment will be described. FIG. 5A is a diagram of the heater 32, the aluminum plate 81, the heater holder 31, and the like according to the present exemplary embodiment viewed in the recording material conveyance direction. FIG. 5B is a schematic view of the heater 32 and the aluminum plate 81 viewed from a heater holder 31 side. FIG. 5C is a schematic cross-sectional view of the vicinity of the fixing nip portion of the fixing device illustrated in an enlarged manner.

As illustrated in FIG. 5A, in the present exemplary embodiment, after attaching the aluminum plate 81 serving as the high heat conducting member to the heater holder 31, the heater 32 is further attached thereto. As a result, a longitudinal middle portion of the heater 32 is supported by the heater holder 31 with the aluminum plate 81 held in between and, furthermore, longitudinal end portions of the heater 32 are directly in contact with and are supported by the heater holder 31. In the contact surfaces between the heater 32 and the aluminum plate 81, it is desirable that a thermal contact resistance between the heater 32 and the aluminum plate 81 is small since the heat efficiency becomes better. Accordingly, in the present exemplary embodiment, the heat stable grease described above is commonly used, and the grease is interposed between the heater 32 and the aluminum plate 81.

As illustrated in FIG. 5B, the substrate of the heater 32 of the present exemplary embodiment is plate shaped and a longitudinal length is 270 mm, a traverse length is 6.0 mm, and a thickness is 1.0 mm. A longitudinal length of the heating resistor 82 is 219 mm, and the heating resistor 82 forms a pattern including two heat generating elements having the same resistance. As illustrated in FIG. 5C, the traverse end portions of the aluminum plate 81 are each bent in a Z shape so that a cross section of the aluminum plate 81 in a direction perpendicular to the longitudinal direction forms a hat shape. A portion of the aluminum plate 81 corresponding to a top crown of the hat is an area (a portion) in contact with the heater 32 including the heat generating resistor 82. Herein, the above area (portion) is referred to as area (a heater contact portion) a, and the maximum length thereof in the longitudinal direction is denoted as A. In the present exemplary embodiment, A is 218 mm. Furthermore, a portion of a hood (a boundary portion between the hood and a sweatband) of the hat shape is an area (a portion) in contact with the fixing film. The above area (portion) is referred to as area (film contact portion) b, and the maximum length thereof in the longitudinal direction is denoted as B. In the present exemplary embodiment, B is 214 mm. In the longitudinal direction of the aluminum plate 81, the longitudinal end portions in area a of the aluminum plate 81 is situated outside the longitudinal end portions in area b. In the present exemplary embodiment, the area (the film contact portion) b of the aluminum plate 81 includes a first film contact portion provided in an area upstream of an upstream end of the heater 32 in a rotation direction of the fixing film 30. Furthermore, the area (the film contact portion) b of the aluminum plate 81 includes a second film contact portion provided in an area downstream of a downstream end of the heater 32 in the rotation direction of the fixing film 30. Note that the configuration may be such that either one of the first film contact portion and the second film contact portion is provided. Note that in the longitudinal direction, area a and area b extend outside of end positions of the maximum-sized recording material on which a toner image can be fixed.

(4) Effect

Generally, as the longitudinal length of the high heat conducting member becomes longer, the effect of suppressing the temperature from increasing in the sheet non-passing portions becomes larger; however, the fixability of the end portions becomes easily degraded due to radiation of heat at the longitudinal end portions of the heater 32 and the fixing film 30. Accordingly, there is a trade-off between the increase in the temperature of the sheet non-passing portion and the fixability of the end portion. By adopting the configuration of the present exemplary embodiment, the suppression of the increase in the sheet non-passing portion temperature and an improvement in the end portion fixability can both be achieved. Such a mechanism will be described hereinafter in the order of "Heat Conduction of Aluminum Plate", "Fixability of End Portion" and "Increase in Sheet Non-passing Portion Temperature".

Heat Conduction of Aluminum Plate

Area a of the aluminum plate 81 is in contact with the heater 32 that has a high temperature; accordingly, the heater 32 is the heat supply source and the aluminum plate 81 receives the heat. Furthermore, area b of the aluminum plate 81 is an area in contact with the fixing film 30 that has a temperature that is lower than the temperature of the heater 32; accordingly, the aluminum plate 81 is the heat supply source, and the fixing film 30 receives the heat. As described above, in addition to the direct supply of heat from the heater 32 to the fixing film 30, supply of heat to the fixing film 30 through the aluminum plate 81 is made possible. If there is no aluminum plate 81, the second surface of the heater 32 becomes a portion in the heater 32 where the heat is easily accumulated; accordingly, by having the aluminum plate 81 come in contact thereto, the thermal diffusivity of the heater 32 becomes improved.

Fixability of End Portion

Figure 6A:
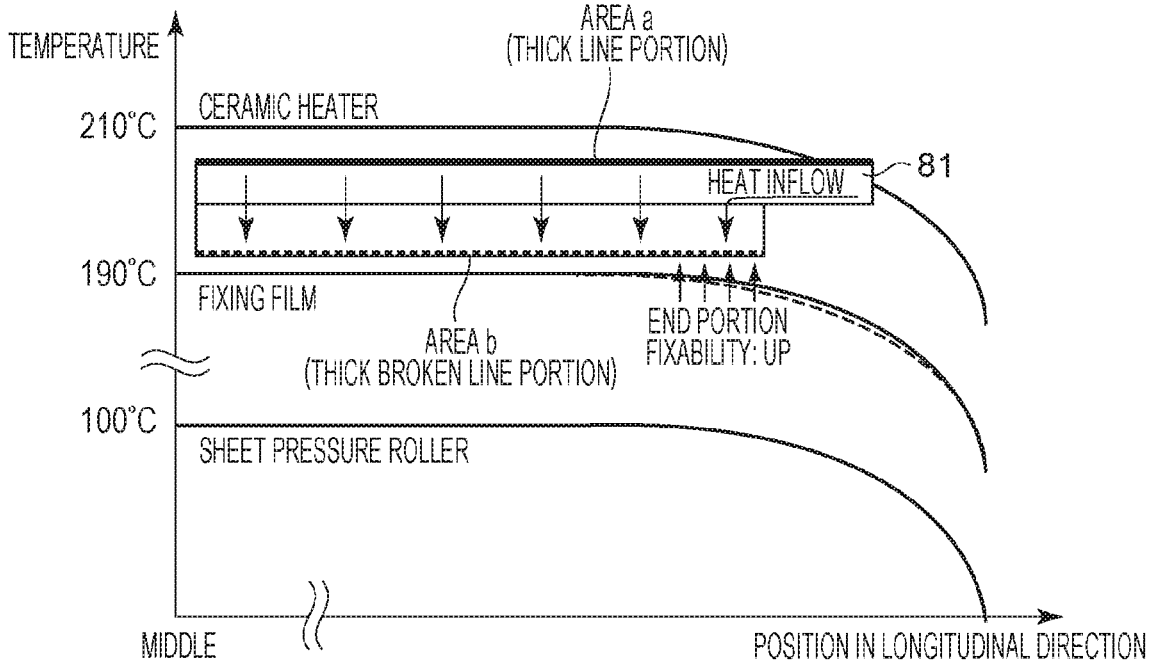
FIG. 6A is a conceptual diagram of a longitudinal temperature distribution of the heater in ordinary use, the fixing film, and the pressure roller when the fixing device according to the first exemplary embodiment is used.

The impact of lengths A and B on the end portion fixability will be described hereinafter. FIG. 6A illustrates a conceptual diagram of a distribution of temperature during ordinary use of the fixing device of the present exemplary embodiment.

Referring first to FIG. 6A, the impact of length A of area a of the aluminum plate 81 on the end portion fixability will be described. As described above, the heat from the heater 32 is received in area a of the aluminum plate 81, and the heat is given to the fixing film 30 in area b. Accordingly, as long as area a of the aluminum plate 81 is in contact with a high-temperature area (a heat generating area) of the heater 32, reception of heat can be expected. Since the heat quantity that can be supplied from area b to the fixing film 30 through the longitudinal end portions of area a of the aluminum plate 81 in contact with the heater 32 is sufficient with respect to the heat quantity that needs to be supplied to the fixing film 30 from the longitudinal end portions of area b of the aluminum plate 81, the end portion fixability is good.

Figure 6B:
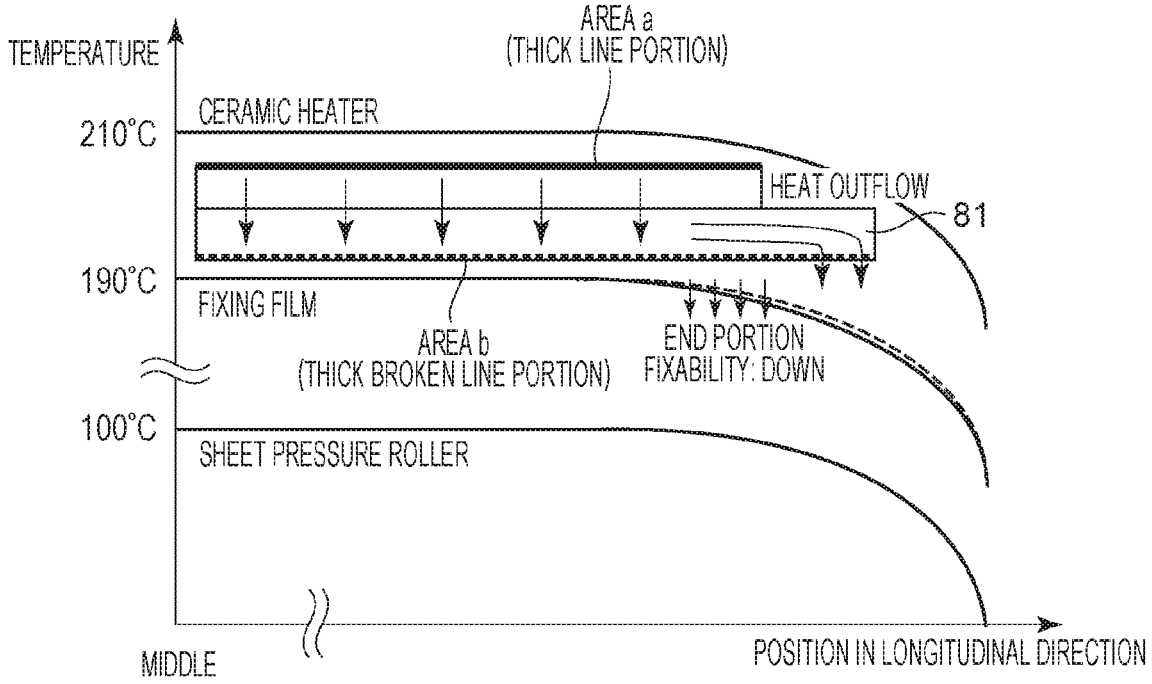
FIG. 6B is a conceptual diagram of a longitudinal temperature distribution of the heater in ordinary use, the fixing film, and the pressure roller when the fixing device according to the first comparative example is used.

FIG. 6B illustrates a conceptual diagram of a distribution of temperature during ordinary use of a fixing device of a comparative example. Herein, in the comparative example, length B of area b is longer than length A of area a of the aluminum plate 81. Referring to FIG. 6B, the impact of length B of area b of the aluminum plate 81 on the end portion fixability will be described. In a case in which length B of area b is longer, when heat is supplied from area b of the aluminum plate 81 to the fixing film 30, the longitudinal end portions of area b come in contact with areas that have temperatures that are lower than the temperature of the longitudinal center of the fixing film 30. Furthermore, area a of the aluminum plate 81 in contact with the high-temperature area of the heater 32 (the heat generating area) becomes smaller compared to that of the present exemplary embodiment. As a result, since the heat quantity supplied to area b from the heater 32 through area a of the aluminum plate 81 is insufficient, the heat quantity supplied to the fixing film 30 from the longitudinal end portions of area b of the aluminum plate 81 becomes insufficient, and the end portion fixability tends to become degraded. If the end portion fixability becomes degraded, when fixing is performed on a recording material with a wide width such as the maximum-sized sheet, there are cases in which an image defect (offsets in the end portions) is created, which is a lack of melting of the toner at the image end portions.

As described above, regarding the end portion fixability, a degradation of the end portion fixability is more less likely to happen when length A of area a is longer than length B of area b of the aluminum plate 81.

Increase in Sheet Non-Passing Portion Temperature

Figure 7A:
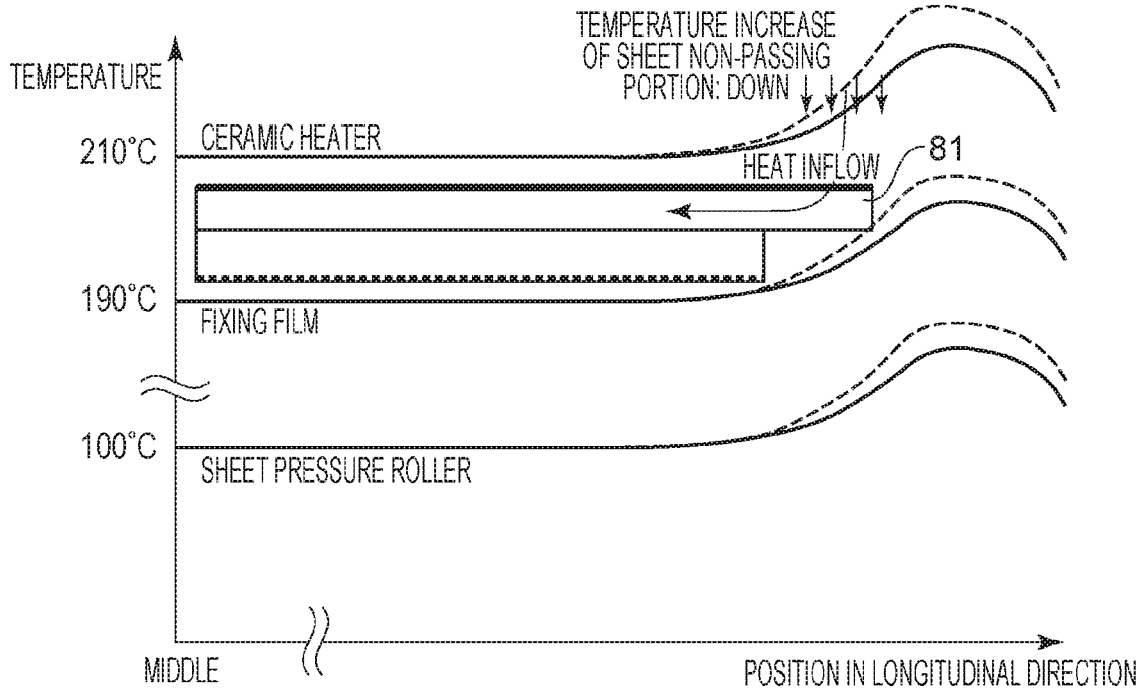
FIG. 7A is a conceptual diagram of a longitudinal temperature distribution of the heater, the fixing film, and the pressure roller when a small-sized recording material is used in the fixing device according to the first exemplary embodiment.
Figure 7B:
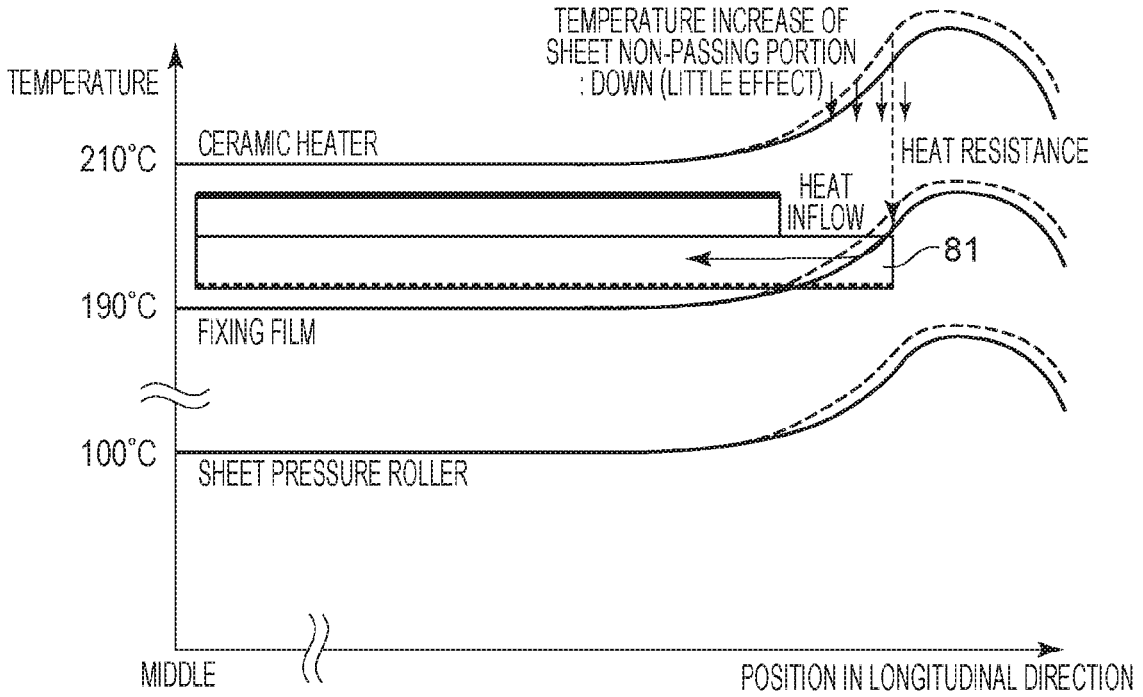
FIG. 7B is a conceptual diagram of a longitudinal temperature distribution of the heater, the fixing film, and the pressure roller when a small-sized recording material is used in the fixing device according to the first comparative example.

FIG. 7A illustrates a conceptual diagram of a distribution of temperature during passing of a small-sized sheet when using the fixing device of the present exemplary embodiment, and FIG. 7B illustrates a conceptual diagram of a distribution of temperature during passing of a small-sized sheet when using the fixing device of the comparative example. When a sheet non-passing portion temperature increase occurs, since the heater 32 is the heat source, it is desirable that the aluminum plate 81 is in direct contact with the heater. As illustrated in FIG. 7A, in the present exemplary embodiment, length A of area a of the aluminum plate 81 in contact with the heater 32 is longer, and the longer the length A becomes, the area in which a heat unifying effect of the heater 32 can be obtained becomes larger and the effect of suppressing the sheet non-passing portion temperature increase becomes larger. On the other hand, as illustrated in FIG. 7B, in the comparative example, since length B of area b of the aluminum plate 81 in contact with the fixing film 30 is longer, the heat accumulated in the heater 32 needs to be made uniform through the fixing film 30; accordingly, the heat unifying effect is poor compared with that of the present exemplary embodiment. As a result, it can be understood that while the effect of suppressing the sheet non-passing portion temperature increase can be seen when length B of area b of the aluminum plate 81 is longer, the effect is smaller compared to when the length A of area a is longer.

As described above, regarding the sheet non-passing portion temperature increase, it can be understood that the effect of suppressing the sheet non-passing portion temperature increase is larger when length A of area a is longer than length B of area b of the aluminum plate 81. Regarding the longitudinal width of the aluminum plate 81, when A is the largest longitudinal width of the area in contact with the heater including the heat generating resistor, and B is the largest longitudinal width of the area in contact with the fixing film, by satisfying B<A, an effect of achieving, at a high level, both the suppression of the sheet non-passing portion temperature increase and the improvement in the end portion fixability can be obtained.

(5) Results of Image Output Experiment

Results of an image output experiment using the present exemplary embodiment will be described next.

The following evaluations of the sheet non-passing portion temperature increase and the offsets in the end portions were performed. The evaluation of the sheet non-passing portion temperature increase will be described first. As the recording material, Canon Red Label (product name, manufactured by Canon Europe) having a grammage of 80 g/m$^2$ and a sheet size of A4 (a small-sized sheet) was used. In a state in which the fixing device is cooled to room temperature, 1000 sheets were printed continuously and the maximum value of the roller surface temperature in the sheet non-passing portion of the pressure roller 33 was measured.

Taking the heat resisting property of the pressure roller 33 (the heat resisting property of the silicone rubber used as the elastic layer), the target was 230° C. Accordingly, a case in which the temperature exceeded 230 degrees was evaluated as x, and in which the temperature was 230 degrees or lower was evaluated as ○.

The evaluation of the offsets in the end portions will be described next. As the recording material, Xerox Vitality Multipurpose Printer Paper Xerox Business 4200 Paper (product name, manufactured by Xerox) having a grammage of 75 g/m$^2$, and a sheet size of Letter or LTR (a maximum-sized sheet) was used. In a state in which the fixing device is cooled to room temperature, a red (Y: 100%+M: 100%) image were printed continuously on 100 sheets. The obtained sheets were checked and the level of offsets in the end portions were evaluated. A case in which there were no offsets was evaluated as ○, a case in which there was a slight offset was evaluated as Δ, and a case in which an offset was generated was evaluated as x.

Regarding the level Δ, while there is a slight offset, the target is ○ having no offset.

The print mode was plain paper mode. In the image forming apparatus used in the experiment, the processing speed was 300 mm/sec, the throughput was 60 sheet per minute. Note that the atmospheric environment under which the experiment was conducted was a temperature of 23° C., and a humidity of 50%.

The evaluation result is shown in Table 1. A description will be given referring to the first row, which is the row of the first exemplary embodiment. As described above, in the present exemplary embodiment, length A of area a of the aluminum plate 81 is 218 mm, and length B of area b is 214 mm. In the present exemplary embodiment, no offsets occurred in the end portions (○), and the sheet non-passing portion temperature was 226° C.

TABLE 1

| | Length of Aluminum Plate | | Offset in End | Sheet Non-passing Portion |
|---|---|---|---|---|
| Configuration | Length A | Length B | Portions | Temperature |
| First Exemplary Embodiment | 218 mm | 214 mm | ○ | 226° C. (○) |
| First Comparative Example | 214 mm | 218 mm | X | 236° C. (X) |
| Second Comparative Example | 216 mm | 216 mm | Δ | 231° C. (X) |
| Third Comparative Example | 214 mm | 214 mm | ○ | 242° C. (X) |
| Fourth Comparative Example | 218 mm | 218 mm | X | 219° C. (○) |

Results of the image output experiment with comparative examples will be described next. In the comparative examples, the configuration of the image forming apparatus and the basic configuration of the fixing device were the same as those of the first exemplary embodiment. In the configuration of the fixing device, only the lengths (the largest longitudinal width A of the area in contact with the heater, and the largest longitudinal width B of the area in contact with the fixing film) of the aluminum plate 81 were different. In the first comparative example, the length A of the aluminum plate was 214 mm, and the length B was 218 mm. In the second comparative example, the length A of the aluminum plate was 216 mm, and the length B was 216 mm. In the third comparative example, the length A of the aluminum plate was 214 mm, and the length B was 214 mm. In the fourth comparative example, the length A of the aluminum plate was 218 mm, and the length B was 218 mm.

Regarding the evaluation method, evaluation was performed with the evaluation method that is the same as the evaluation method used in the case of the present exemplary embodiment. The evaluation results are as shown in Table 1. In the first comparative example, there were offsets in the end portions (x), and the sheet non-passing portion temperature was 236° C. In the second comparative example, there were slight offsets in the end portions (Δ), and the sheet non-passing portion temperature was 231° C. In the third comparative example, no offsets occurred in the end portions (○), and the sheet non-passing portion temperature was 242° C. In the fourth comparative example, there were offsets in the end portions (x), and the sheet non-passing portion temperature was 221° C. It can be understood that, compared with the first to fourth comparative examples, the present exemplary embodiment can achieve, at a high level, both the suppression of the sheet non-passing portion temperature increase and the improvement of the end portion fixability.

As described above, both the suppression of the sheet non-passing portion temperature increase and the improvement of the end portion fixability can be achieved at a high level by having the longitudinal end portions of area a of the aluminum plate be extended outside of the longitudinal end portions of area b in the longitudinal direction of the aluminum plate.

Second Exemplary Embodiment

In the present exemplary embodiment, an example in which a configuration using a graphite sheet serving as a high heat conducting member that is different from the aluminum plate used in the first exemplary embodiment has been applied to the present disclosure will be described. The configuration of the image forming apparatus is similar to that of the first exemplary embodiment, which is illustrated in FIG. 1. Accordingly, redundant description will be omitted.

Figure 8:
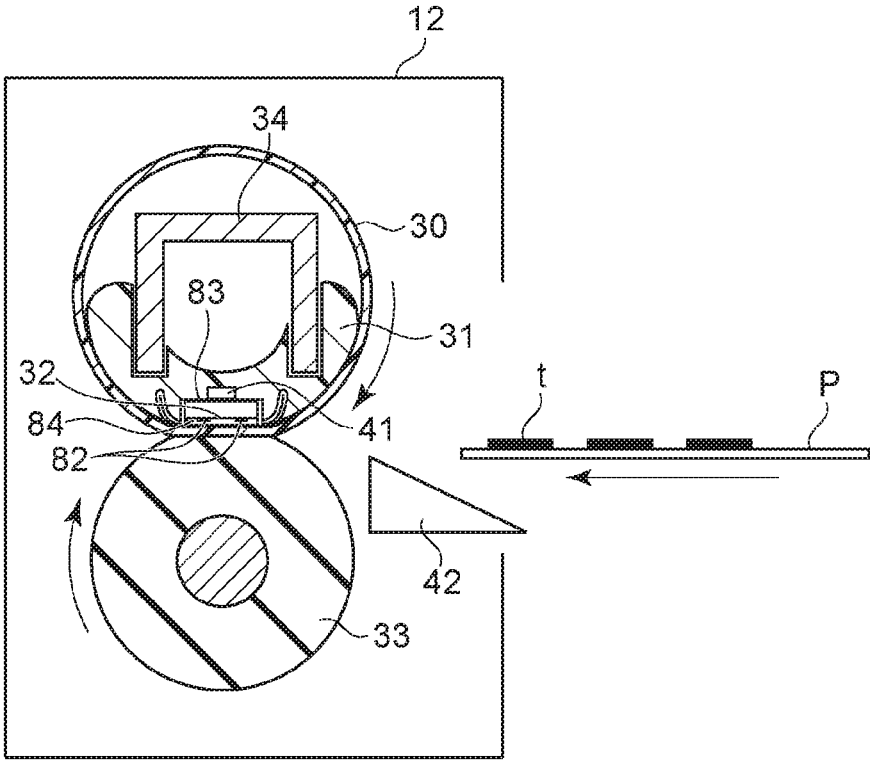
FIG. 8 is a schematic cross-sectional view of a fixing device according to a second exemplary embodiment.

FIG. 8 is a cross-sectional view illustrating a fixing device of a color image forming apparatus according to a second exemplary embodiment. Description that overlap the first exemplary embodiment will be omitted. The point in the second exemplary embodiment that is different from the first exemplary embodiment, which is the feature of the second exemplary embodiment, is that rather than the aluminum plate 81, a graphite sheet 83 is used. The graphite sheet 83 is formed by two-dimensionally crystallized carbon being stacked into a sheet shape, and is a material in which the thermal conductivity of the sheet surface has been increased extremely. As illustrated in FIG. 8, the graphite sheet 83 serving as the high heat conducting member is provided on the back surface of the heater 32. Similar to the first exemplary embodiment, a groove is provided on the side of the heater holder 31 opposing the pressure roller 33, and the heater 32 is fitted in the groove and is supported at the desired position. In so doing, the graphite sheet 83 is disposed between the heater 32 and the heater receiving groove. The graphite sheet 83 is bent so that the cross section thereof is hat shaped. The graphite sheet 83 is disposed so as to be in contact with the rotating fixing film 30 while in contact with the heater 32. In the cross section of the graphite sheet 83, two end sides (the ends of the hood of the hat) are stuck into and held by the heater holder 31.

Figure 9A:
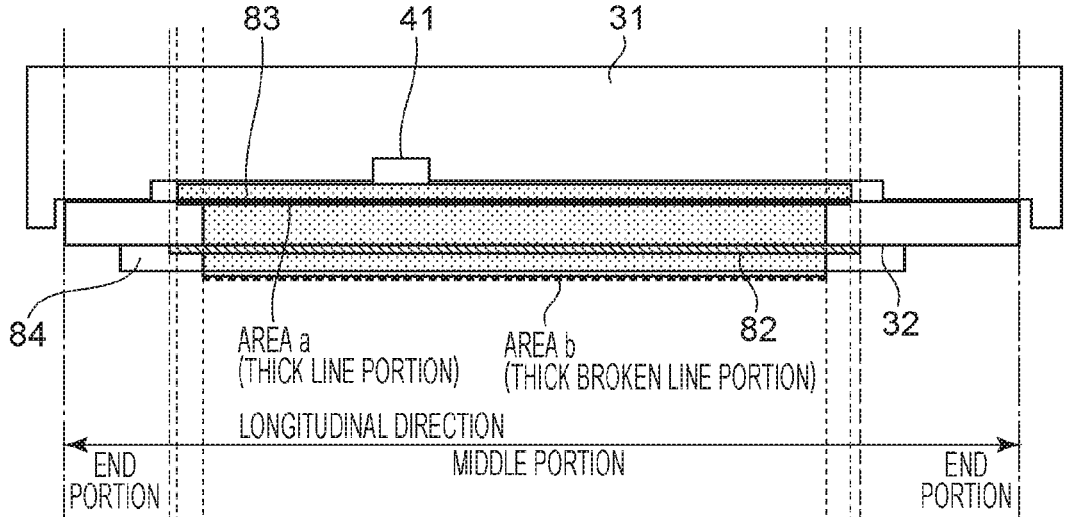
FIG. 9A is a schematic view of the heater, a graphite sheet, the heater holder, and the like according to the second exemplary embodiment viewed in the conveyance direction.
Figure 9B:
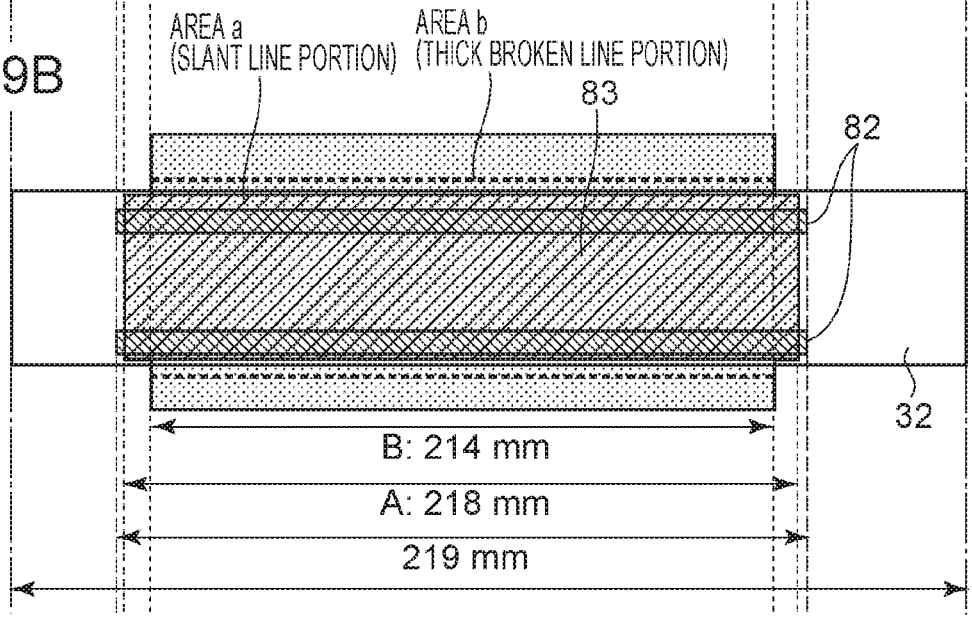
FIG. 9B is schematic view of the heater and the graphite sheet viewed from the heater holder side according to the second exemplary embodiment.

Referring to FIGS. 9A and 9B, positional relationship of the graphite sheet 83 serving as the high heat conducting member of the present exemplary embodiment will be described. FIG. 9A is a diagram of the heater 32, the graphite sheet 83, the heater holder 31, and the like according to the present exemplary embodiment viewed in the recording material conveyance direction. FIG. 9B is a schematic view of the heater 32 and the graphite sheet 83 according to the present exemplary embodiment viewed from the heater holder 31 side.

As illustrated in FIG. 9A, in the present exemplary embodiment, after attaching the graphite sheet 83 serving as the high heat conducting member to the heater holder 31, the heater 32 is further attached thereto. As a result, a longitudinal middle portion of the heater 32 is supported by the heater holder 31 with the graphite sheet 83 held in between and, furthermore, longitudinal end portions of the heater 32 are in contact with and are supported by the heater holder 31.

The graphite sheet 83 has a sheet shape having a thickness of 0.2 mm and, as illustrated in FIG. 9B, regarding the longitudinal direction widths thereof, the length A is 218 mm and the length B is 214 mm, which is a similar length relationship as that of the first exemplary embodiment.

Since the graphite sheet 83 is flexible compared with a case in which metal is used as the high heat conducting member, the graphite sheet 83 easily adheres to the heater 32 upon installment, and the thermal contact resistance between the graphite sheet 83 and the heater 32 tends to be small. Accordingly, there is no need to have grease between the contact surfaces of the graphite sheet 83 and the heater 32, and in the present exemplary embodiment, grease is not applied to the above portion.

Furthermore, the graphite sheet 83 has a characteristic in that compared with a case in which metal is used as the high heat conducting member, the graphite sheet 83 has a small heat capacity. Accordingly, there is an advantage in that the temperature during heating of the fixing device can be raised quickly. Moreover, since the graphite sheet 83 improves the thermal conductivity of the sheet surface by aligning graphite on the sheet surface, a higher thermal conductivity can be obtained more easily. In the sheet used in the present exemplary embodiment, the thermal conductivity is 600 W/(m·K). The grade of the material is different according to the degree of orientation, and the thermal conductivity is different depending on the grade. A sheet that has higher thermal conductivity such as a sheet having a thermal conductivity of 1500 W/(m·K) can be used. With the above, both "the sheet non-passing portion temperature increase" and "the offsets in the end portions" can be suppressed at a further high level. Furthermore, compared with a case in which an aluminum plate is used, there is a restriction in the thickness thereof (that is, the number of thickness grades distributed is smaller than that of aluminum), and the installing method and the holding method needs to be worked out.

Since the effect obtained when using the present exemplary embodiment is similar to that of the first exemplary embodiment, description thereof is omitted herein.

As described above, by employing the configuration of the present exemplary embodiment, both the suppression of the sheet non-passing portion temperature increase and improvement in the end portion fixability can be achieved at a further higher level.

Third Exemplary Embodiment

The present disclosure has been described in the first and second exemplary embodiments using longitudinal length A of area a and longitudinal length B of area b. The above configurations are configurations that can obtain the effect of the present disclosure in both the longitudinal end portions of the image forming apparatus. In the present exemplary embodiment, a configuration in which the effect is obtained on at least either one side (longitudinally one end side) will be described.

As an example in which the present exemplary embodiment is effectively used, a configuration will be described in which a reference for the conveying (sheet-passing) position is a one-side reference. The configuration of the image forming apparatus is similar to that of the first exemplary embodiment, which is illustrated in FIG. 1. Furthermore, a cross section of the fixing device in the longitudinal direction is similar to that of the first exemplary embodiment, which is as illustrated in FIG. 2. Accordingly, redundant description will be omitted.

Figures 10A, 10B:
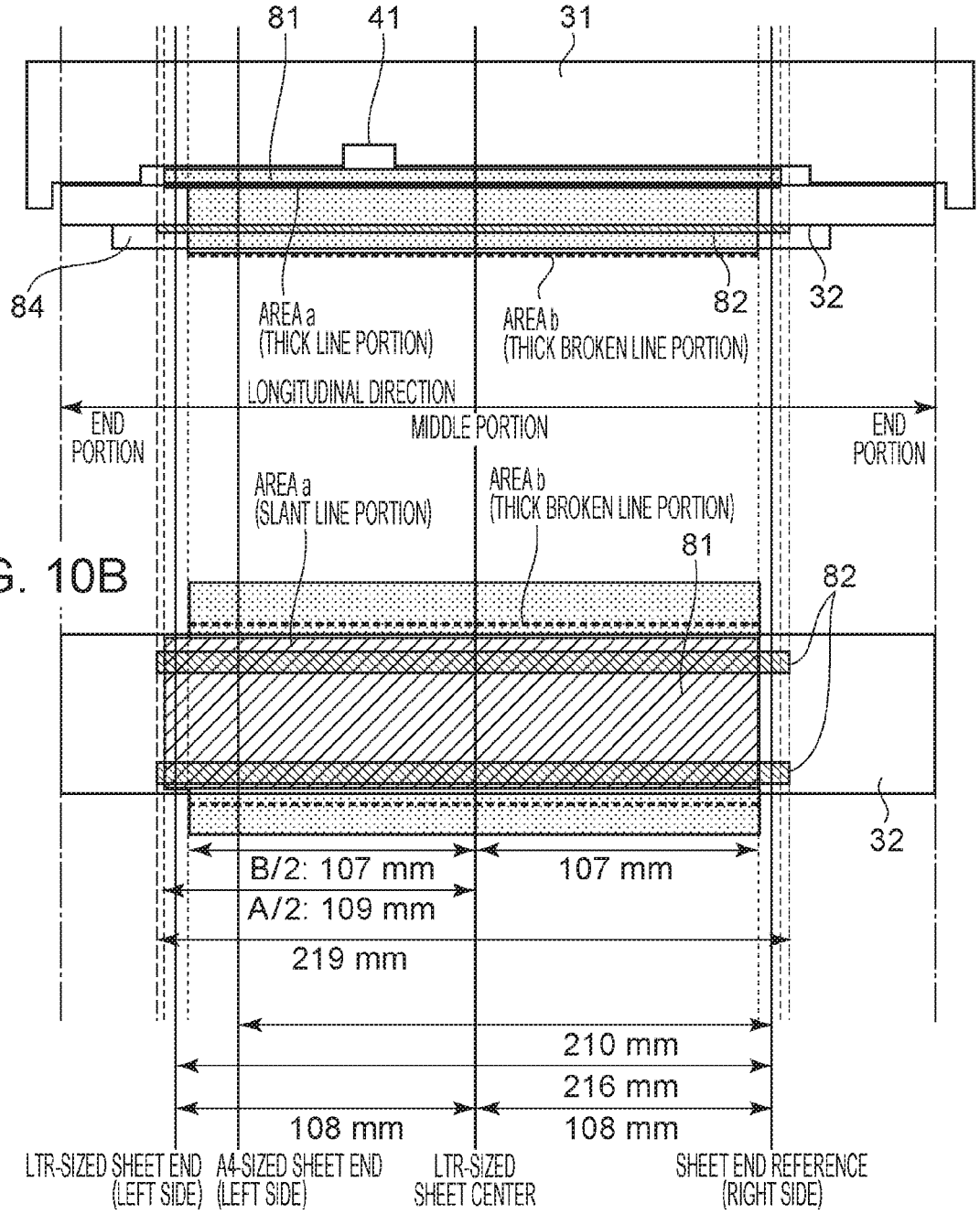
FIG. 10A is a schematic view of the heater, the aluminum plate, the heater holder, and the like according to a third exemplary embodiment viewed in the conveyance direction.
FIG. 10B is schematic view of the heater and the aluminum plate viewed from the heater holder side according to the third exemplary embodiment.

Referring to FIGS. 10A and 10B, a longitudinal positional relationship of the aluminum plate 81 of the present exemplary embodiment that is different from that of the first exemplary embodiment will be described. FIG. 10A is a diagram of the heater 32, the aluminum plate 81, the heater holder 31, and the like according to the present exemplary embodiment viewed in the recording material conveyance direction. FIG. 10B is a schematic cross-sectional view of the heater 32 and the aluminum plate 81 according to the present exemplary embodiment viewed from a heater holder 31 side. As illustrated in FIGS. 10A and 10B, in the present exemplary embodiment, the conveyance reference is on the right side in the drawing, and the right ends of the LTR-sized sheet and the A4-sized sheet are at the same position. In such a case, even if a A4-sized sheet is passed, the sheet non-passing portion temperature increase on the right side of the drawing is not severe. Accordingly, the suppression of the increase in the sheet non-passing portion temperature and an improvement in the end portion fixability can be both achieved easily on the right side. Accordingly, it is only sufficient that the configuration of the present exemplary embodiment is a configuration in which the effect is obtained on only the left side of the drawing.

In order to obtain the effect on only one side, one only needs to consider the longitudinal length from the sheet (the recording material) reference. Herein, a description will be given using a distance between the center of the LTR-sized sheet passing position and the left side end portion (the end portion in which the effect is expected to be obtained) of the aluminum plate 81 in the drawing. The configuration of the left side end portion of the aluminum plate 81 end portion to obtain the effect of the present exemplary embodiment is the same configuration as that of the first exemplary embodiment. In other words, the largest longitudinal length between the "center of the LTR-sized sheet passing area" and the "left side end portion of the area in contact with the heater 32 of the aluminum plate 81" corresponding to length A is 109 mm (half of length A of the first exemplary embodiment). Furthermore, the largest longitudinal length between the "center of the LTR-sized sheet passing area" and the "left side end portion of the area in contact with the fixing film 30 of the aluminum plate 81" corresponding to length B is 107 mm (half of length B of the first exemplary embodiment).

Meanwhile, the right side in the drawing may have the configuration of the third comparative example in which the offset in the end portion is ○. Accordingly, the largest longitudinal length between the center of the LTR-sized sheet passing area and the right side end portion of area a of the aluminum plate 81 is 107 mm, and the largest longitudinal length between the center of the LTR-sized sheet passing area and the right side end portion of area b of the aluminum plate 81 is 107 mm.

As described above, by employing the configuration of the present exemplary embodiment, both the suppression of the sheet non-passing portion temperature increase and improvement in the end portion fixability can be achieved at a further higher level.

Fourth Exemplary Embodiment

Figure 11A:
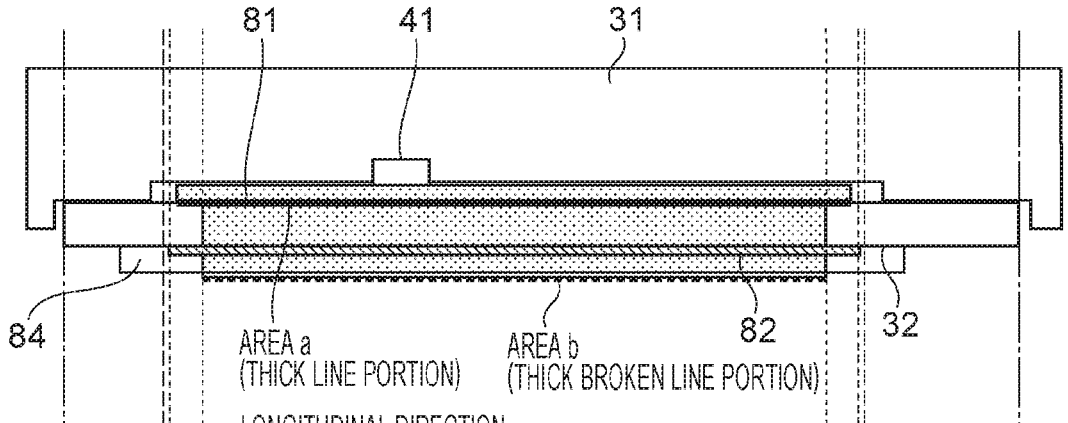
FIG. 11A is a schematic view of the heater, the aluminum plate, the heater holder, and the like according to a fourth exemplary embodiment viewed in the conveyance direction.
Figure 11B:
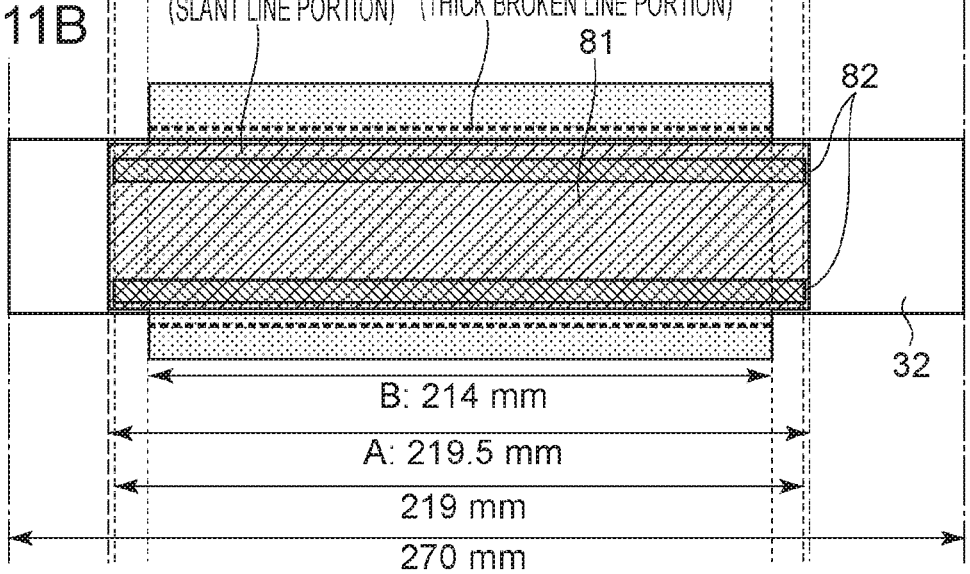
FIG. 11B is schematic view of the heater and the aluminum plate viewed from the heater holder side according to the fourth exemplary embodiment.
Figure 12A:
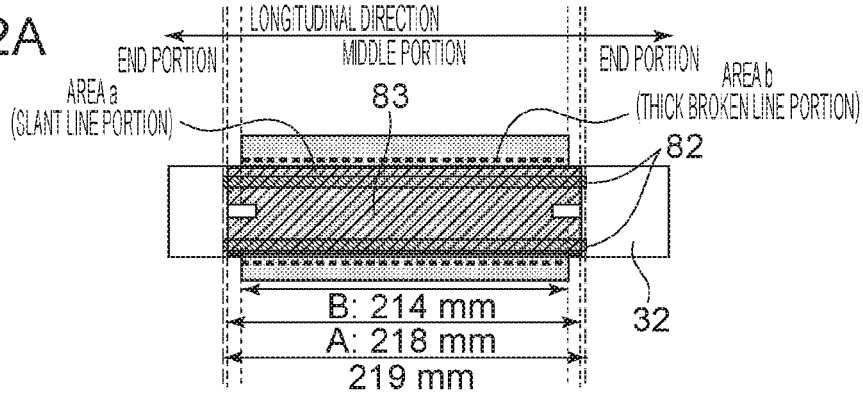
FIGS. 12A to 12D are schematic views of the heater and the heat conducting member viewed from the heater holder side, according to a modification example of the present exemplary embodiment.
Figure 12B:
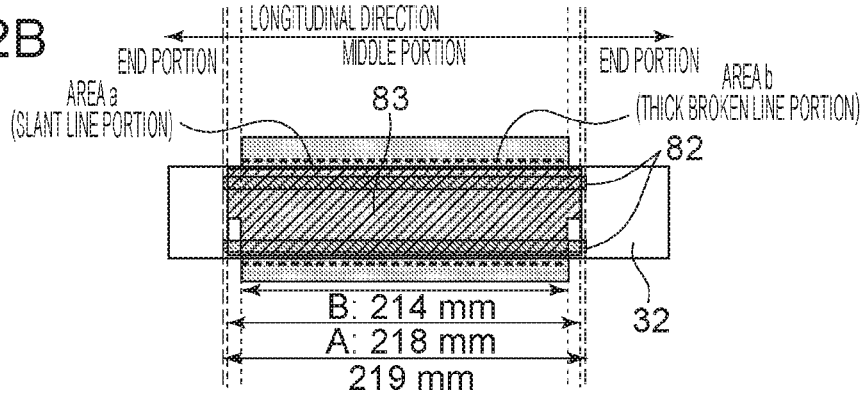
Figure 12C:
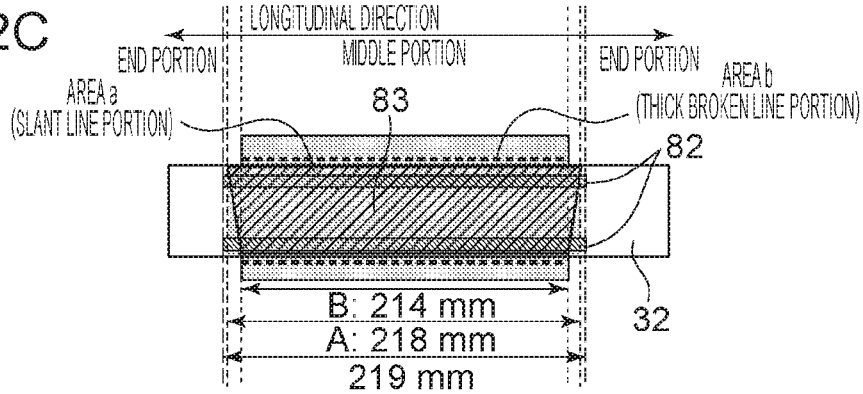
Figure 12D:
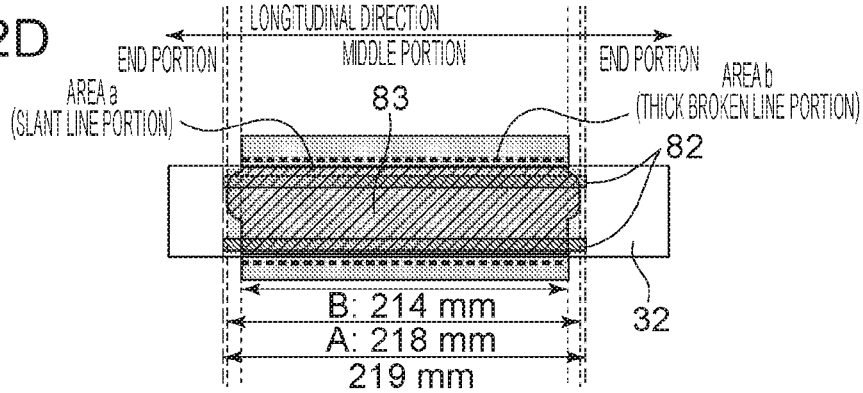

In the present exemplary embodiment, an example in which the configuration used in the first exemplary embodiment, in which the length A of the aluminum plate differs, is applied to the present disclosure will be described. The configuration of the image forming apparatus is similar to that of the first exemplary embodiment, which is illustrated in FIG. 1. Furthermore, the configuration of the fixing device is similar to that of the first exemplary embodiment, which is illustrated in FIG. 2. Accordingly, redundant description will be omitted. Referring to FIGS. 11A and 11B, a longitudinal positional relationship of the aluminum plate 81 of the present exemplary embodiment that is different from that of the first exemplary embodiment will be described. FIG. 11A is a diagram of the heater 32, the aluminum plate 81, and the heater holder 31 according to the present exemplary embodiment viewed in the recording material conveyance direction. FIG. 11B is a schematic cross-sectional view of the heater 32 and the aluminum plate 81 according to the present exemplary embodiment viewed from a heater holder 31 side. In the present exemplary embodiment, length A of the aluminum plate is 219.5 mm and length B is 214 mm. The feature of the present exemplary embodiment is that length A of the aluminum plate 81 is longer than the longitudinal length of the heating resistor 82 of the heater 32 (219 mm).

Hereinafter, results of an image output experiment using the present exemplary embodiment will be described, and the effect of the present exemplary embodiment will be stated. The configuration of the image forming apparatus and the basic configuration of the fixing device were the same as those of the first exemplary embodiment. In the configuration of the fixing device, the length of the aluminum plate was different. Regarding the evaluation method, evaluation was performed with the evaluation method that is the same as the evaluation method used in the case of the first exemplary embodiment. The evaluation results are as shown in Table 2.

TABLE 2

| | Length of Aluminum Plate | | Offset in End | Sheet Non-passing Portion |
|---|---|---|---|---|
| Configuration | Length A | Length B | Portions | Temperature |
| First Exemplary Embodiment | 218 mm | 214 mm | ○ | 226° C. (○) |
| Fourth Exemplary Embodiment | 219.5 mm | 214 mm | ○ | 221° C. (○) |

The result of the first exemplary embodiment is as described in the description of the first exemplary embodiment. In the fourth exemplary embodiment, no offsets occurred in the end portions (○), and the sheet non-passing portion temperature was 221° C. The sheet non-passing portion temperature increase suppressing effect was larger than that of the first exemplary embodiment. Furthermore, the width of area b of the aluminum plate 81 is desirably longer than 206 mm (left right margin 5 mm) which is the largest image forming area (image guaranteed area) of the LTR-sized sheet (width about 216 mm) that is the recording material with the largest width that can be used in the image forming apparatus of the present exemplary embodiment. In other words, the longitudinal end portions of area b of the aluminum plate 81 is desirably outside of the end portions of the largest image forming area in the longitudinal direction of the aluminum plate.

Modification Examples

Hereinafter, modification examples of the first to fourth exemplary embodiments will be described. In the first to fourth exemplary embodiments, the heating resistor 82 of the heater 32 forms a pattern including two heat generating elements extending in the longitudinal direction in which the width (a resistance value) of the two heat generating elements are the same in the traverse direction throughout the longitudinal direction; however, the configuration of the heater is not limited to the above. The heater may be a heater in which the resistance of the heating resistor 82 in the longitudinal direction is adjusted so that the middle and the end portions have different heat generation amounts, or may be a heater in which the heat distribution of the heater can be controlled by actuating a plurality of heating resistors having different lengths in the longitudinal direction individually or in an interlocked manner. The heater may be a heater in which the heating resistor forms a pattern including a single heat generating element.

Furthermore, in the first to fourth exemplary embodiments, the present disclosure has been described using a fixing device including the heater 32. However, a similar effect can be obtained with a configuration in which a heating member, such as a polyimide sheet heater, a silicon rubber heater, or a sheath heater, and the fixing film can be in contact with each other and in which the thermal conductivity of the high heat conducting member is higher than those of the base material of the heating member and the fixing film. The present disclosure can be applied to such a configuration.

Furthermore, in the first to fourth exemplary embodiments, the present disclosure has been described using a configuration in which the longitudinal lengths of the area a between the heater 32 and the high heat conducting member are uniform at A in the recording material conveyance direction. However, a similar effect can be obtained in a configuration in which the lengths A are not uniform. FIGS. 12A to 12D illustrate examples of the above. FIGS. 12A to 12D are diagrams of the heater and the heat conducting member viewed from the heater holder side. As illustrated in FIGS. 12A to 12D, it is only sufficient that the largest longitudinal length A is longer than B, and a similar effect can be obtained.

Figure 13:
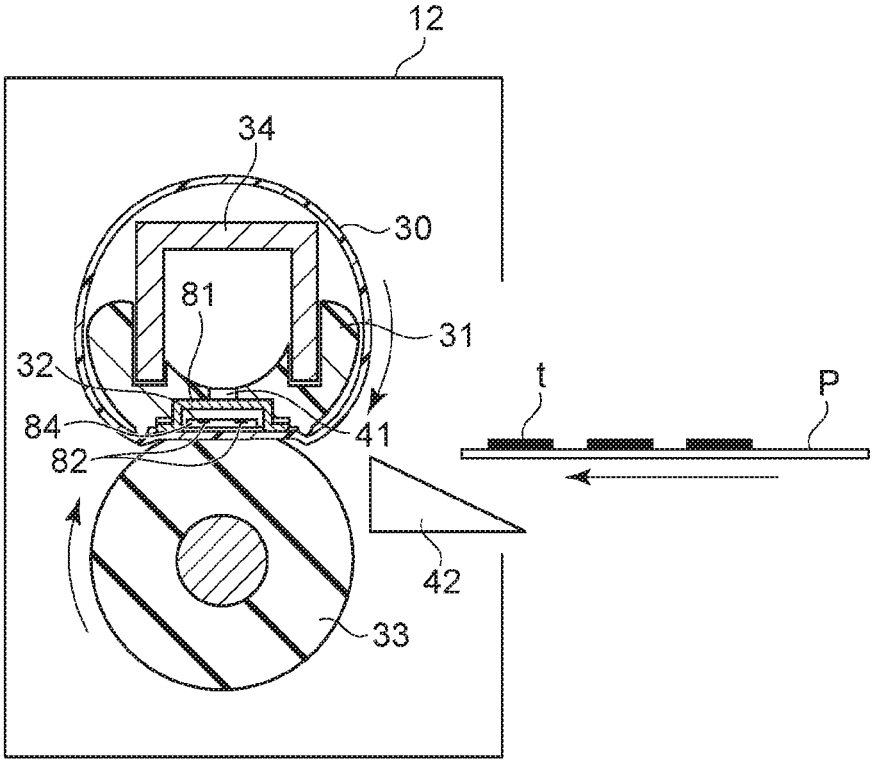
FIG. 13 is a schematic cross-sectional view of a fixing device according to a modification example of an exemplary embodiment.

Furthermore, in the first to fourth exemplary embodiments, the present disclosure has been described using a configuration in which the heater holder 31 has a shape that does not interrupt the cylindrical shape of the fixing film 30. However, as illustrated in FIG. 13, the present disclosure can be applied to a configuration in which the heater holder 31 is provided with protrusions that follow the shape of the round shape of the pressure roller 33.

Furthermore, in the fourth exemplary embodiment described above, the present disclosure has been described using the longitudinal lengths A and B of the high heat conducting member. Such a configuration can be applied to only one side between the longitudinal two end portions of the image forming apparatus. As in the third exemplary embodiment, in order to obtain the effect on only one side, one only needs to consider the length in the width direction from the center in the sheet (recording material) width direction. For example, with the LTR-sized sheet passing center as the reference, the largest width of area a is set to A/2, and the largest width of area b is set to B/2. Furthermore, with the LTR-sized sheet passing center corresponding to the above as the reference, one is to consider the largest longitudinal length to the one side end portion of the heating resistor 82 of the heater 32, and the largest longitudinal length to the one side end portion of the largest image forming area (the image guaranteed area) in the maximum sheet-passing width.

Fifth Exemplary Embodiment

In the present exemplary embodiment, the shape of the aluminum plate 81 is different from that of the first exemplary embodiment; however, other configurations are the same and description thereof is omitted. Details of the aluminum plate 81 of the present exemplary embodiment will be described.

Figure 14A:
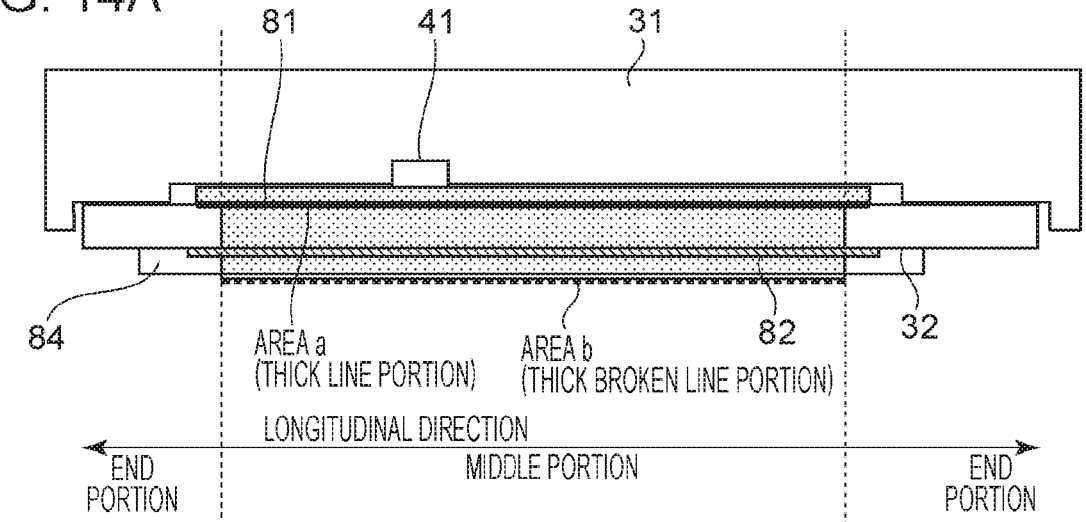
FIG. 14A is a schematic view of the heater, the aluminum plate, the heater holder, and the like according to a fifth exemplary embodiment viewed in the conveyance direction.
Figure 14B:
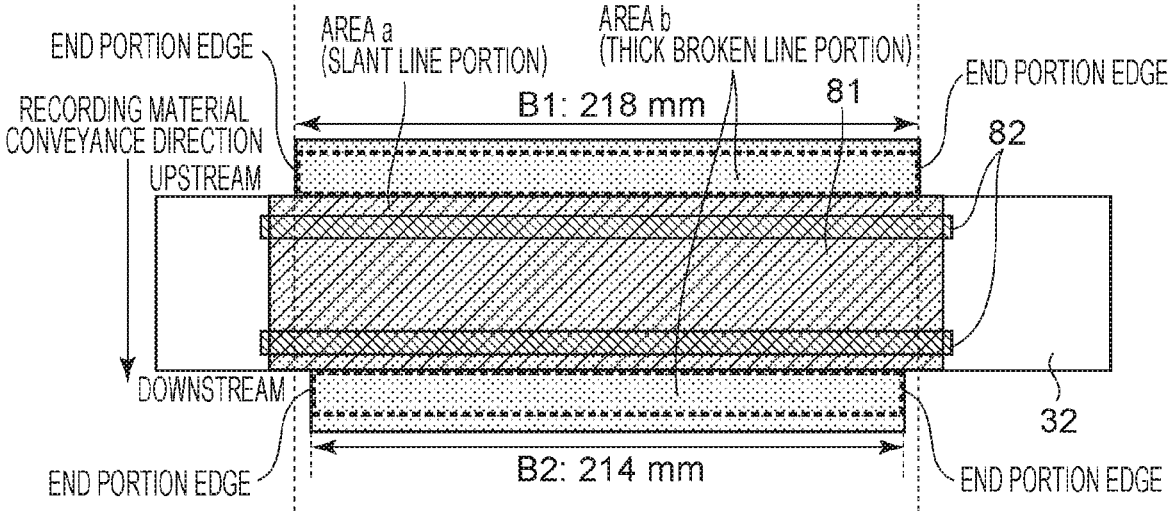
FIG. 14B is schematic view of the heater and the aluminum plate viewed from the heater holder side according to the fifth exemplary embodiment.
Figure 14C:
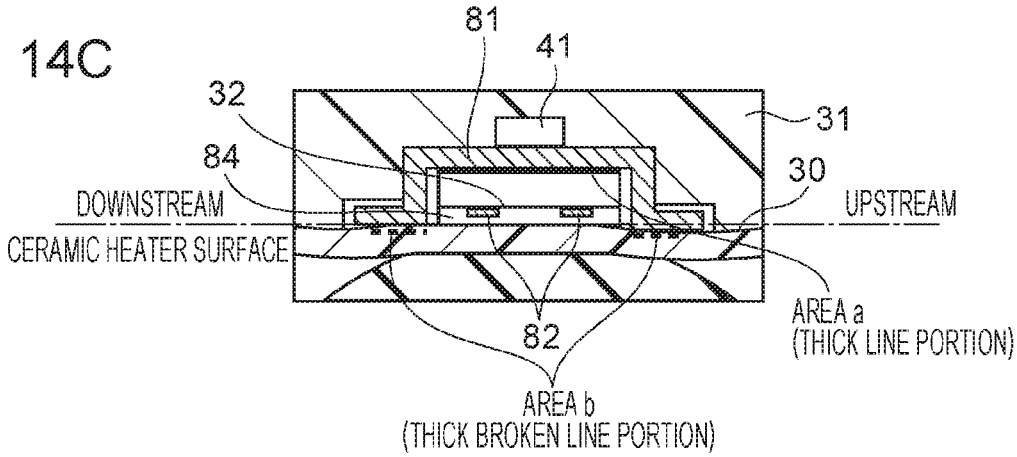
FIG. 14C is a schematic cross-sectional view of a vicinity of a nip portion of the fixing device according to the fifth exemplary embodiment.

Referring to FIG. 14, a longitudinal positional relationship of the aluminum plate 81 serving as the high heat conducting member of the present exemplary embodiment will be described. FIG. 14A is a diagram of the heater 32, the aluminum plate 81, the heater holder 31, and the like according to the present exemplary embodiment viewed in the recording material conveyance direction. FIG. 14B is a schematic cross-sectional view of the heater 32 and the aluminum plate 81 according to the present exemplary embodiment viewed from a heater holder 31 side. Furthermore, FIG. 14C is a schematic cross-sectional view of the vicinity of the fixing nip portion.

As illustrated in FIG. 14A, in the present exemplary embodiment, after attaching the aluminum plate 81 serving as the high heat conducting member to the heater holder 31, the heater 32 is further attached thereto. As a result, a longitudinal middle portion of the heater 32 is supported by the heater holder 31 with the aluminum plate 81 held in between and, furthermore, longitudinal end portions of the heater 32 are in contact with and are supported by the heater holder 31.

In the contact surfaces between the heater 32 and the aluminum plate 81, it is desirable that a thermal contact resistance between the heater 32 and the aluminum plate 81 is small since the heat efficiency becomes better. Accordingly, in the present exemplary embodiment, the heat stable grease described above is commonly used, and the grease is interposed between the heater 32 and the aluminum plate 81.

As illustrated in FIG. 14B, the substrate of the heater 32 of the present exemplary embodiment is plate shaped and a length in the longitudinal direction is 270 mm, a length in the traverse direction is 6.0 mm, and a thickness is 1.0 mm. A longitudinal length of the heating resistor 82 is 219 mm, and the heating resistor 82 forms a pattern including two heat generating elements having the same resistance.

As illustrated in FIG. 14C, the aluminum plate 81 is bent in a Z shape so that a cross section thereof forms a hat shape. A portion of the aluminum plate 81 corresponding to a top crown of the hat is an area (a portion) in contact with the heater 32. Herein, the above area (portion) is referred to as area (the heater contact portion) a, and a portion of a hood (a boundary portion between the hood and a sweatband) of the hat shape is an area (a portion) in contact with the fixing film. The above area (portion) is referred to as area (film contact portion) b. In the present exemplary embodiment, the longitudinal length B1 of area b upstream of the portion corresponding to the hood of the hat shape in the recording material conveyance direction is 218 mm, and the length B2 of area b on the downstream side is 214 mm, so as to be set shorter than the longitudinal length (232 mm) of the fixing film 30. The length B of area b1 upstream of the aluminum plate 81 is 218 mm so that even when the LTR-sized sheet (216 mm wide) that is the recording material with the largest width is conveyed with some variation, heat is conducted to the portions of the fixing film 30 through where the recording material end portions pass. Furthermore, as illustrated in FIG. 14C, the area b upstream of the aluminum plate 81 is, in the pressure applying direction of the nip portion, projected to the pressure roller 33 side with respect to the surface (the first surface) of the heater 32 in contact with the fixing film 30. This is to, in a case in which a recording material to which a staple has been stapled is passed through, prevent the fixing film to become damaged by the staple caught in the edge portion of the heater 32 on the upstream side. In a sense of preventing the fixing film 30 from being damaged by the staple as well, desirably, the length B1 of area b upstream of the aluminum plate 81 is wider than the width of the recording material having the largest width. Meanwhile, since area b downstream of the aluminum plate 81 does not have any concern of damaging the fixing film 30 with a staple, area b has substantially the same height as that of the first surface of the heater 32 and the longitudinal length B2 is smaller than the width of the recording material with the largest width. By reducing the longitudinal length B2 of area b downstream of the aluminum plate 81, heat supplied to the end portion of the fixing film 30 decreases slightly; however, that can be adjusted by the length or the like of the heating resistor.

Since the heat of the first surface and the heat of the second surface, opposite to the first surface, from the heater 32 can be supplied to the fixing film 30 through the aluminum plate 81, the heating efficiency of the fixing film 30 can be improved substantially.

However, in the longitudinal end portions of the area where the aluminum plate 81 and the fixing film 30 are in contact with each other, the fixing film 30 may gradually become scraped by sliding between the metal edges and the inner surface of the fixing film 30. In particular, when the positions of the edges of the longitudinal end portions of the area b upstream of the aluminum plate 81 and the area b downstream of the aluminum plate 81 are the same, the scraping of the two become added; accordingly, the scraping of the inner surface of the fixing film 30 becomes more noticeable. Accordingly, in the present exemplary embodiment, the position of the longitudinal end portion of area b upstream of the aluminum plate 81 and the position of the longitudinal end portion of area b on the downstream side, which is on the same side, are different. Note that in order to reduce the scraping of the inner surface of the fixing film 30 with the edge of the longitudinal end portion, the undercut side of the aluminum plate 81 when the aluminum plate 81 is punched to its shape is situated on the side in contact with the fixing film 30. Furthermore, processing such as grinding and the like may be performed.

Results of an experiment using the present exemplary embodiment will be described next. In order to verify, with the configuration of the present exemplary embodiment, the scraping effect on the inner surface of the fixing film caused by the edge portion of the end portion in the longitudinal direction of the aluminum plate 81, a sheet passing durability test was performed. The recording material used in the sheet passing durability test was a Letter-sized sheet (maximum-sized sheet) having a grammage of 75 g/m$^2$. Furthermore, as for the sheet passing mode, a sheet passing mode for single sheet intermittent printing in which the number of rotations of the fixing film is the largest and that is most strict on the scrapped inner surface of the fixing film was performed, and the scraped amount of the inner surface of the fixing film was measured for each 50,000 sheets with a surface roughness tester (SURFCOM 1500SD2 manufactured by TOKYO SEIMITSU CO., LTD.). The processing speed of the image forming apparatus used in the experiment was 200 mm/sec, the throughput with LTR short edge feeding was 40 sheets per minute, and the lifetime of the apparatus was a hundred thousand sheets. Note that the atmospheric environment under which the experiment was conducted was a temperature of 23° C., and a humidity of 50%.

The evaluation result is shown in Table 3. In the configuration of the present exemplary embodiment, as described above, length B1 of area b upstream of the aluminum plate 81 was 218 mm, length B2 of area b on the downstream side was 214 mm, and the edge of the end portion of the aluminum plate 81 was slid and rubbed against the inner surface of the fixing film on the upstream side and on the downstream side at different positions. On the other hand, in the configuration of a fifth comparative example, the lengths on the upstream side and on the downstream side of the aluminum plate 81 were both 218 mm and, in the longitudinal direction of the aluminum plate 81, the edge portions of the longitudinal end portions of the aluminum plate 81 on the upstream side and on the downstream side were slid against the inner surface of the fixing film 30 at substantially the same position.

TABLE 3

| | Length of Aluminum Plate | | Evaluation Result (Scraped Amount) | |
|---|---|---|---|---|
| Configuration | Upstream | Downstream | 50,000 sheets | 100,000 sheets |
| Fifth Exemplary Embodiment | 218 mm | 214 mm | 4 μm | 8 μm |
| Fifth Comparative Example | 218 mm | 218 mm | 8 μm | 16 μm |

The evaluation results are as shown in Table 3. In the configuration of the present exemplary embodiment, even when sheet passing of 100,000 sheets, which is the lifetime of the apparatus, was performed, the scraped amount of the inner surface of the fixing film was relatively small.

On the other hand, in the configuration of the fifth comparative example, the scraped amount of the inner surface of the fixing film after 100,000 sheets, which is the lifetime of the fixing device, had been passed was twice the scraped amount of the present exemplary embodiment. Note that the length of area b of the aluminum plate 81 indicated in the present exemplary embodiment is an example, and may be configured in various manners according to the length of the heating resistor 82 of the heater 32, the heat distribution, and the configuration of the pressure roller 33. It goes without saying that a similar effect can be obtained by providing the edge portions of the longitudinal edge portions of the aluminum plate 81 at different positions on the upstream side and the downstream side of the fixing nip portion (the rotation direction of the fixing film 30).

As described above, by providing the edges of the longitudinal end portions of the aluminum plate on the upstream side and on the downstream side at different positions, damage such as the scraping of the inner surface of the fixing film can be reduced, and a fixing device that has an elongated lifetime, and that is capable of high speed printing can be provided.

Sixth Exemplary Embodiment

Figure 15A:
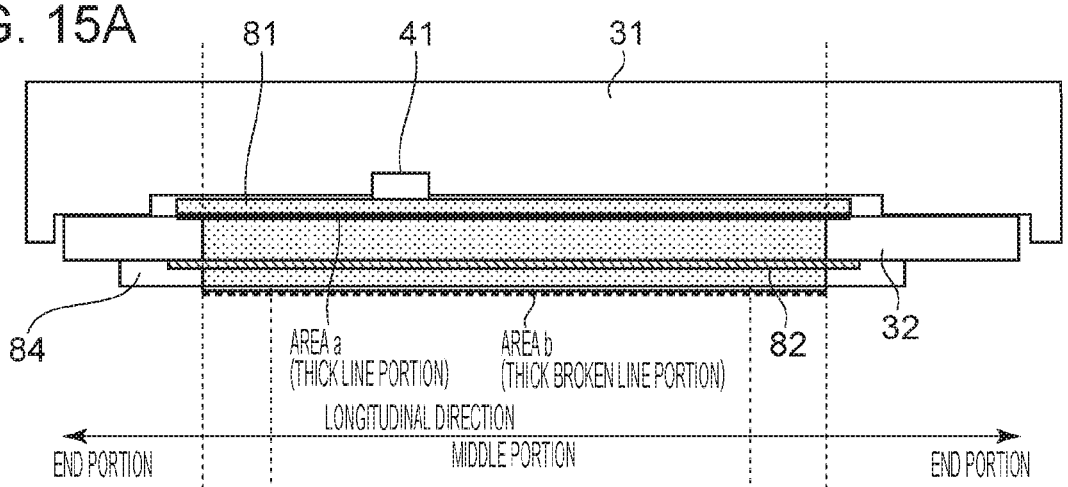
FIG. 15A is a schematic view of the heater, the aluminum plate, the heater holder, and the like according to a sixth exemplary embodiment viewed in the conveyance direction.
Figure 15B:
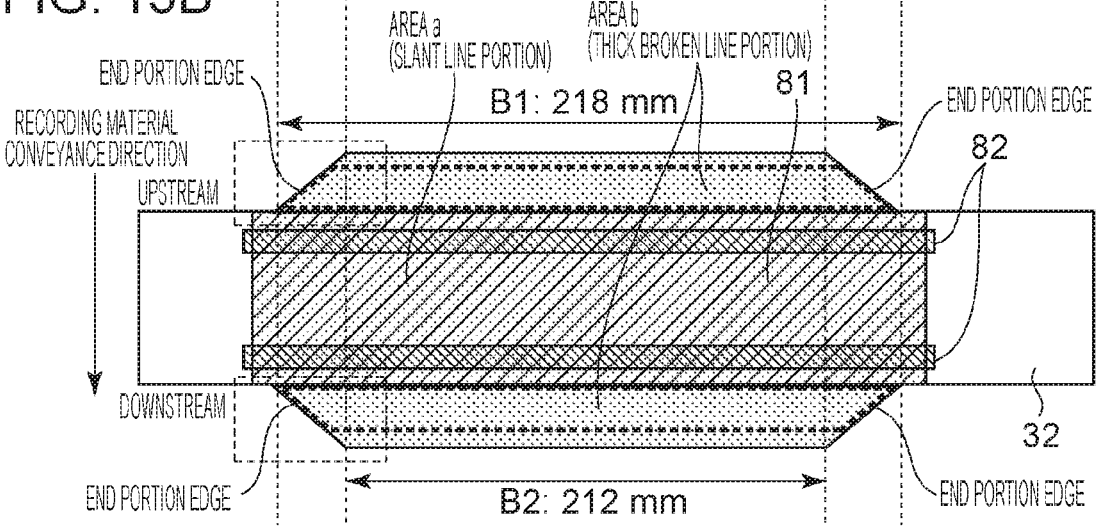
FIG. 15B is schematic view of the heater and the aluminum plate viewed from the heater holder side according to the sixth exemplary embodiment.
Figure 15C:
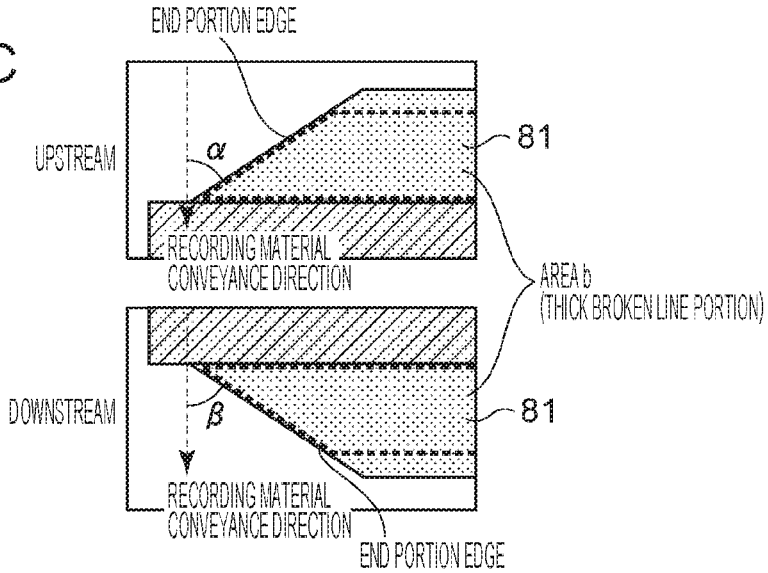
FIG. 15C is an enlarged view of longitudinal end portions of the aluminum plate according to the sixth exemplary embodiment.

In the present exemplary embodiment, the edges of the longitudinal end portions of the aluminum plate 81 serving as the high heat conducting member used in the fifth exemplary embodiment are formed obliquely at predetermined angles against the conveyance direction of the recording material as in FIGS. 15A to 15C. Such a configuration will be described. Note that the configuration of the image forming apparatus is similar to that of the first exemplary embodiment, and redundant description thereof will be omitted.

Referring to FIGS. 15A to 15C, an edge shape of the aluminum plate 81 serving as the high heat conducting member of the present exemplary embodiment will be described. FIG. 15A is a diagram of the heater, the aluminum plate, the heater holder, and the like according to the present exemplary embodiment viewed in the conveyance direction. FIG. 15B is a diagram of the heater and the aluminum plate viewed from the heater holder side. Furthermore, FIG. 15C is an enlarged view of the longitudinal end portions of the aluminum plate according to the present exemplary embodiment.

As illustrated in FIG. 15C, a feature of the present exemplary embodiment is that the edges of the longitudinal end portions of area b of the aluminum plate 81 is formed obliquely at angle α on the upstream side and at angle β on the downstream side in the recording material conveyance direction. With such a characteristic configuration, the sliding and rubbing portion between the inner surface of the fixing film 30 and the edges of the aluminum plate 81 is dispersed, and the scraping can be reduced. The angles α and β are about 5° to 85°, more preferably, are 20° to 70°. In the present exemplary embodiment, an example of a configuration in which the angles α and β are both 60° will be described; however, the angles α and β may be set at different angles.

Figure 16A:
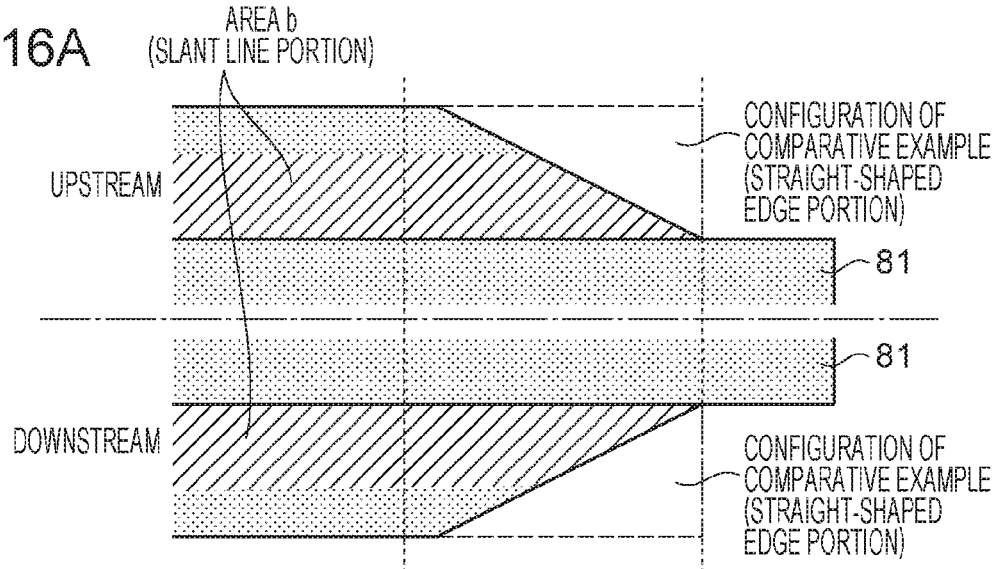
FIG. 16A is an enlarged view of longitudinal end portions of the aluminum plate according to the sixth exemplary embodiment.
Figure 16B:
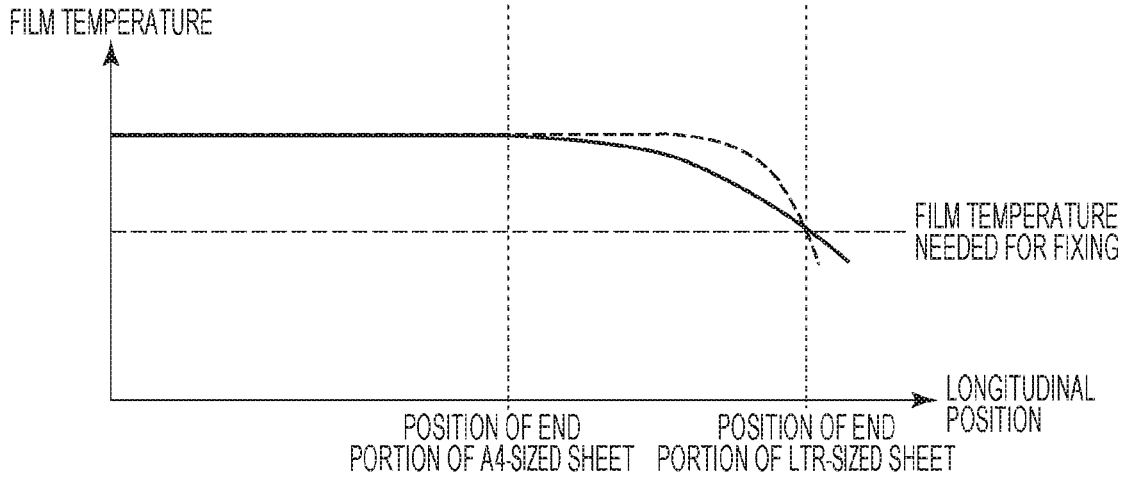
FIG. 16B illustrates a temperature portion of the fixing film corresponding to the longitudinal end portions of the aluminum plate.
Figure 16C:
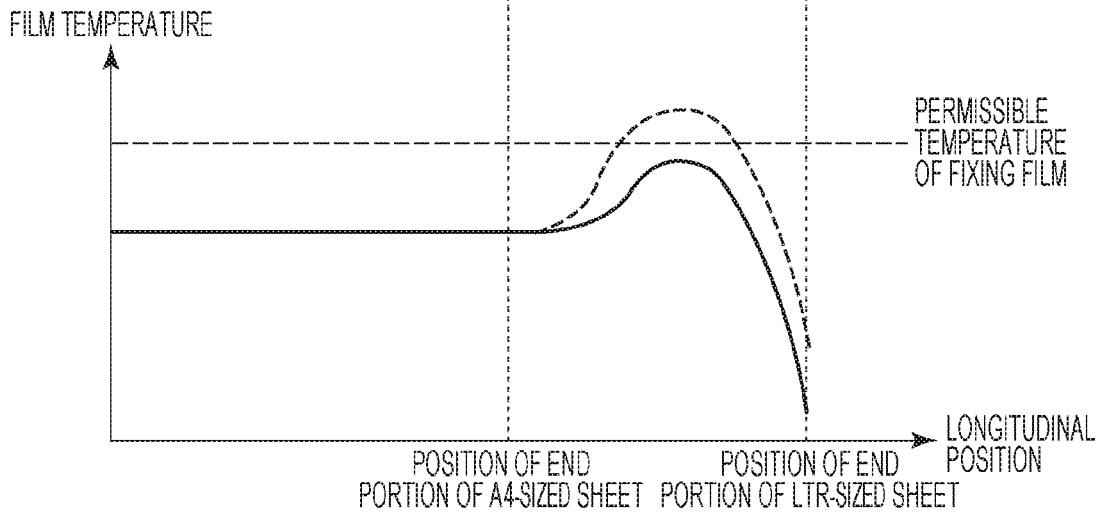
FIG. 16C illustrates a temperature portion of the fixing film corresponding to the longitudinal end portions of the aluminum plate.

As in the case of the present exemplary embodiment, by forming the longitudinal end portions of the edge portions of the aluminum plate 81 in oblique shapes, the change in temperature of the fixing film 30 near the edge portion can be made moderate and the effect of being capable of reducing the end portion temperature increase can be obtained. Referring to FIGS. 16A to 16C, the reducing effect of the sheet non-passing portion temperature increase will be described. FIG. 16A is a diagram of the edge of longitudinal end portion of the aluminum plate 81 illustrated in an enlarged manner. The solid line in FIG. 16A illustrates the shape of the present exemplary embodiment, and the broken line (straight-shaped edge) is a sixth comparative example. FIGS. 16B and 16C are conceptual diagrams of temperature distributions in the longitudinal direction of the fixing film 30 when fixing processes have been performed on an LTR-sized recording material and an A4-size recording material. In the present exemplary embodiment, the area of the area b of the aluminum plate 81 in contact with the fixing film 30 is gradually reduced towards the outside in the longitudinal direction. Accordingly, as in the solid lines in FIGS. 16B and 16C, the temperature of the fixing film 30 gradually changes towards the longitudinal end portion of the fixing film 30. On the other hand, in the sixth comparative example, as in the broken line in FIGS. 16B and 16C, since the area of the area b of the aluminum plate 81 changes abruptly, the temperature of the fixing film 30 changes abruptly as well. In order to maintain the temperature of the fixing film 30 to a temperature allowing the longitudinal end portions to be fixed, the sixth comparative example needs to be configured so that the longitudinal end portions also become high in temperature. With the above, it can be understood that when a fixing process is continuously performed on the A4-sized recording materials that have a width that is smaller than the LTR-sized recording material, compared with the sixth comparative example, it is less likely that the sheet non-passing portion temperature increase becomes deteriorated in the present exemplary embodiment.

Results of an experiment using the present exemplary embodiment will be described next. A comparison between, the configuration of the present exemplary embodiment described above in which the edge portions of the aluminum plate 81 had oblique shapes (60°) and a configuration of the sixth comparative example in which the lengths on the upstream side and the downstream side of the aluminum plate 81 were both 218 mm and in which the edges of the end portion were slid at substantially the same portion of the fixing film 30 had been made.

TABLE 4

| Configuration | Shape of Edge of Aluminum Plate | Evaluation Result (Scraped Amount) 50,000 sheets | 100,000 sheets |
|---|---|---|---|
| Sixth Exemplary Embodiment | Oblique Shape (60°) | 2 μm | 4 μm |
| Sixth Comparative Example | Straight | 8 μm | 16 μm |

The evaluation results are as shown in Table 4. In the configuration of the present exemplary embodiment, even when sheet passing (fixing process) of 100,000 sheets, which is the lifetime of the apparatus, was performed, the scraped amount of the inner surface of the fixing film 30 was small. On the other hand, in the sixth comparative example, when sheet passing of 100,000 sheets, which is the lifetime of the apparatus, was performed, the scraped amount of the inner surface of the fixing film 30 was larger than that of the sixth exemplary embodiment.

Note that in the present exemplary embodiment, a configuration in which the aluminum plate 81 and the fixing film 30 come in contact with each other at both upstream and downstream areas of the fixing nip has been described; however, even with a configuration in which only the upstream side of the fixing nip or the downstream side of the fixing nip comes in contact with the aluminum plate 81 and the fixing film 30, a similar effect can be obtained.

Furthermore, in the configuration of the present exemplary embodiment, since the edges of the longitudinal end portions of the contact areas b of the aluminum plate 81 have oblique shapes, the technical difficulty in the bending step of the aluminum plate during manufacturing is high, which affects the component cost and the component accuracy. Accordingly, in accordance with the characteristics of the apparatus such as the required lifetime and the cost, it is desirable that the configuration of the sixth comparative example (straight edge portion) or the configuration of the present exemplary embodiment (oblique-shaped edge portion) is selected.

As described above, by adopting the configuration of the present exemplary embodiment, damage such as scraping and the like of the inner surface of the fixing film can be reduced, and a fixing device that has an elongated lifetime, and that is capable of high speed printing can be provided.

Seventh Exemplary Embodiment

The image forming apparatus of the present exemplary embodiment has, other than the processing speed being 250 mm/sec, the throughput being, with the LTR short edge feeding, 50 sheets per minute, and the lifetime of the apparatus being 300,000 sheets, a similar configuration to that of the first exemplary embodiment and redundant description thereof will be omitted.

Figure 17A:
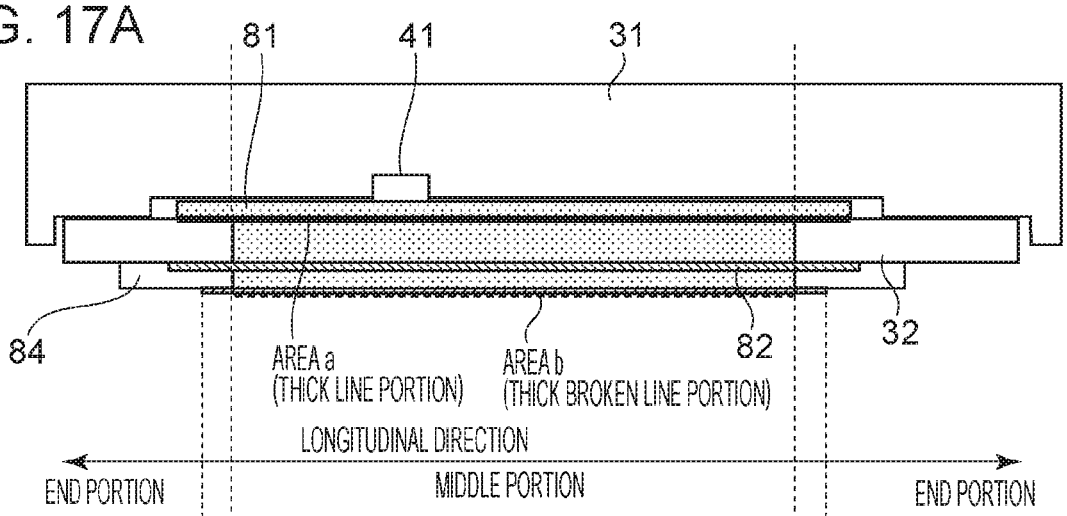
FIG. 17A is a schematic view of the heater, the aluminum plate, the heater holder, and the like according to a seventh exemplary embodiment viewed in the conveyance direction.
Figure 17B:
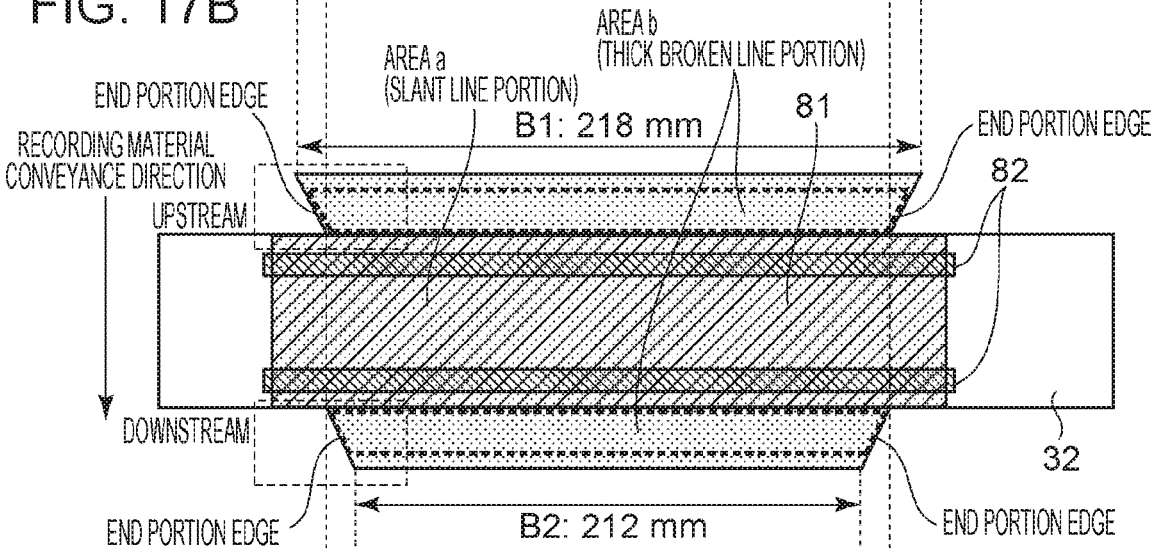
FIG. 17B is schematic view of the heater and the aluminum plate viewed from the heater holder side according to the seventh exemplary embodiment.
Figure 17C:
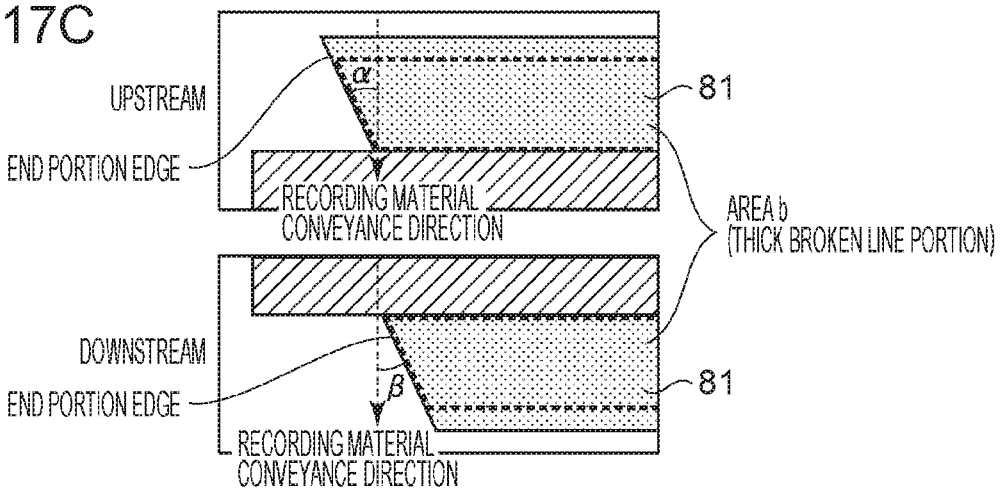
FIG. 17C is an enlarged view of longitudinal end portions of the aluminum plate according to the seventh exemplary embodiment.

Referring to FIGS. 17A to 17C, edge shapes of the aluminum plate 81 serving as the high heat conducting member of the present exemplary embodiment will be described. FIG. 17A is a diagram of the heater, the aluminum plate, the heater holder, and the like according to the present exemplary embodiment viewed in the recording material conveyance direction. FIG. 17B is a diagram of the heater and the aluminum plate viewed from the heater holder side. Furthermore, FIG. 17C is an enlarged view of the longitudinal end portions of the aluminum plate.

As illustrated in FIG. 17C, in the present exemplary embodiment, the edges of the longitudinal end portions of area b of the aluminum plate 81 in contact with the fixing film 30 are formed obliquely at angle α on the upstream side and at angle β on the downstream side against the recording material conveyance direction. With the above configuration, the sliding and rubbing portion between the inner surface of the fixing film 30 and the edges of the aluminum plate 81 is dispersed, and the scraping can be reduced. Furthermore, since the positions of the edges of the aluminum plate 81 are different between the upstream side and the downstream side of the fixing nip portion, the sliding and rubbing portion on the inner surface of the fixing film 30 can be dispersed. The angles α and β are about 5° to 85°, more preferably, are 20° to 70°. In the present exemplary embodiment, an example of a configuration in which the angles α and β are both 40° will be described; however, the angles α and β may be set at different angles. Furthermore, in the present exemplary embodiment, the edge of the end portion upstream of the aluminum plate 81 also slides in a forward direction with respect to the proceeding direction of the fixing film 30, which is the best configuration in suppressing the scraping of the inner surface of the fixing film 30.

Results of an experiment using the present exemplary embodiment will be described next. In the configuration of the present exemplary embodiment, as described above, the edges of areas b of the aluminum plate 81 had oblique shapes (40°) and the edges upstream and downstream of the fixing nip portion were at different positions. As the comparative example 7, the configuration of the sixth exemplary embodiment was used. The evaluation method was similar to that of the first exemplary embodiment, and comparison was made based on the evaluations. Furthermore, the processing speed of the image forming apparatus used in the experiment was 250 mm/sec, the throughput with LTR short edge feeding was 50 sheets per minute, and the lifetime of the apparatus was a hundred thousand sheets.

TABLE 5

| | Evaluation Result (Scraped Amount) | |
|---|---|---|
| Configuration | 200,000 sheets | 300,000 sheets |
| seventh Exemplary Embodiment | 6 μm | 9 μm |
| seventh Comparative Example | 10 μm | 16 μm |

The evaluation results are as shown in Table 5. In the configuration of the present exemplary embodiment, even when sheet passing of 300,000 sheets, which is the lifetime of the apparatus, was performed, the scraped amount of the inner surface of the fixing film 30 was smaller than that of the seventh comparative example. However, while the lifetime of the apparatus of the seventh comparative example is inferior to the configuration of the present exemplary embodiment, the effect of suppressing the sheet non-passing portion temperature increase was superior to that of the present exemplary embodiment; accordingly, the configuration is desirably selected in accordance with the characteristics of the apparatus.

Figure 18:
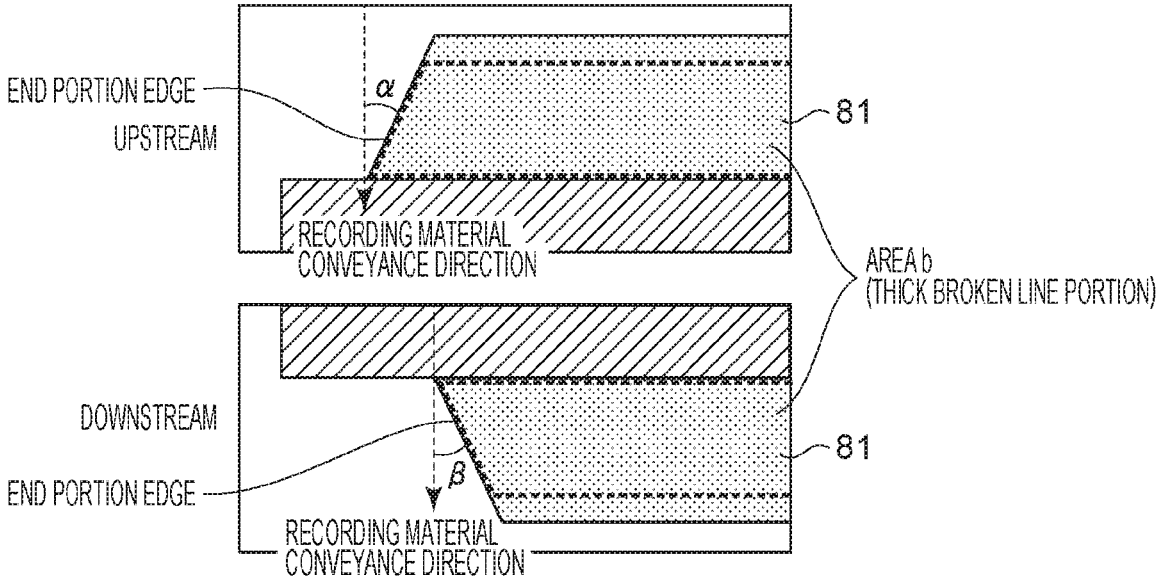
FIG. 18 is an enlarged view of longitudinal end portions of the aluminum plate according to a modification example of the seventh exemplary embodiment.

Furthermore, it has been confirmed that there is an effect of reducing the scraping of the inner surface of the fixing film 30 even in the configuration illustrated in FIG. 18 serving as a modification example of the present exemplary embodiment. However, the edge of the longitudinal end portion upstream of the aluminum plate 81 slides in a direction countering the proceeding direction of the fixing film 30, the effect of reducing the scraping of the inner surface of the fixing film 30 is smaller than that of the present exemplary embodiment. However, the difficulty in manufacturing is smaller in the configuration in FIG. 18 since the width of the front end portion is larger than the width of the base of the bending in the aluminum plate; accordingly, the configuration is desirably selected in accordance with the required characteristics such as the device cost and accuracy.

As described above, by adopting the configuration of the present exemplary embodiment, damage such as scraping and the like of the inner surface of the fixing film 30 can be reduced, and a fixing device that has an elongated lifetime, and that is capable of high speed printing can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-199625 filed Oct. 13, 2017, which is hereby incorporated by reference herein in its entirety.

What is claimed is:

1. A fixing device that heats a toner image and fixes the toner image on a recording material, the fixing device comprising:

a rotatable tubular film;

a heater including a substrate and a heat generating resistor formed on the substrate, the heater including a first surface that is in contact with an inner surface of the film and a second surface that is on an opposite side of the first surface, the heater extending in a longitudinal direction of the substrate; and a heat conducting member including a heater contact portion in contact with the second surface of the heater, the heat conducting member extending in the longitudinal direction, wherein the heat conducting member includes a film contact portion, the film contact portion being in contact with an inner circumferential surface of the film, and wherein, on at least in the longitudinal direction, the heat generating resistor extends outside of the film contact portion, and the heater contact portion extends outside of the film contact portion.

2. The fixing device according to claim 1, wherein, on one side in the longitudinal direction, the heater contact portion extends outside of a passing area of a maximum size recording material to which the toner image can be fixed.

3. The fixing device according to claim 1, wherein, on one side in the longitudinal direction, the film contact portion extends outside of a passing area of a maximum size recording material to which the toner image can be fixed.

4. The fixing device according to claim 1, wherein, in the heat conducting member, one end of the heater contact portion and one end of the film contact portion are connected to each other with a portion, extending from the second surface towards the first surface, interposed therebetween.

5. The fixing device according to claim 1, wherein a thermal conductivity of the heat conducting member is high compared with a thermal conductivity of the substrate.

6. The fixing device according to claim 1, wherein a thermal conductivity of the heat conducting member is high compared with a thermal conductivity of the film.

7. The fixing device according to claim 1, further comprising a roller that forms a nip portion together with the heater with the film interposed therebetween, the nip portion conveying and heating the recording material on which the toner image has been formed.

8. The fixing device according to claim 7, wherein the film contact portion includes:

a first film contact portion at a position upstream in a moving direction in which the film moves at the nip portion and adjacent to the first surface, the first film contact portion coming in contact with the inner circumferential surface of the film, and a second film contact portion at a portion downstream in the moving direction and adjacent to the first surface, the second film contact portion coming in contact with the inner circumferential surface of the film.

9. The fixing device according to claim 8, wherein in one side in the longitudinal direction, positions of an edge of the first film contact portion and an edge of the second film contact portion differ.

10. The fixing device according to claim 9, wherein, on one side in the longitudinal direction, the first film contact portion extends outside of the second film contact portion.

11. The fixing device according to claim 1, wherein, on the other side in the longitudinal direction, the heat generating resistor extends outside of the film contact portion, and the heater contact portion extends outside of the film contact portion.

* * * * *